US005981115A

United States Patent [19]

Furuya et al.

[11] Patent Number: 5,981,115

[45] Date of Patent: Nov. 9, 1999

[54] REVERSIBLE THERMOSENSITIVE RECORDING MATERIAL

[75] Inventors: Hiromi Furuya; Tadafumi Tatewaki; Fumio Kawamura; Kyoji Tsutsui, all of Shizuoka-ken, Japan

[73] Assignee: Ricoh Company, Ltd., Tokyo, Japan

[21] Appl. No.: 08/993,559

[22] Filed: Dec. 18, 1997

[30] Foreign Application Priority Data

Dec. 20, 1996 [JP] Japan ..... 8-354658
Dec. 16, 1997 [JP] Japan ..... 9-363229

[51] Int. Cl.[6] ..... B41M 5/30

[52] U.S. Cl. ..... 430/19; 430/945; 430/964; 503/201; 503/214

[58] Field of Search ..... 430/19, 945, 964; 503/201, 214, 216, 217, 218, 221

[56] References Cited

U.S. PATENT DOCUMENTS 5,185,194 2/1993 Miyake et al. .
5,229,189 7/1993 Hiyoshi et al. .
5,250,346 10/1993 Nagai et al. .
5,306,687 4/1994 Furuya et al. .
5,380,693 1/1995 Goto .
5,403,810 4/1995 Swamura et al. .
5,447,900 9/1995 Suzaki et al. .
5,482,912 1/1996 Furuya et al. .
5,521,138 5/1996 Shimada et al. .
5,532,201 7/1996 Goto .
5,547,500 8/1996 Tsutsui .
5,641,724 6/1997 Yamaguchi et al. .

FOREIGN PATENT DOCUMENTS 62-015236 1/1987 Japan .
5-085045 4/1993 Japan .
5-124360 5/1993 Japan .
6-344659 12/1994 Japan .
7-047766 2/1995 Japan .
7047766 2/1995 Japan .
7052553 2/1995 Japan .
7-257050 10/1995 Japan .
9-254545 9/1997 Japan .
9254545 9/1997 Japan .

*Primary Examiner*—John A. McPherson
*Attorney, Agent, or Firm*—Cooper & Dunham LLP

[57] ABSTRACT

A reversible thermosensitive recording material which includes a recording layer including a resin, an electron donating coloring agent and an electron accepting coloring developer and in which an image is reversibly formed and erased by appropriately heating and cooling the recording layer, wherein the resin includes a resin crosslinked with the isocyanate compound. The reversible thermosensitive recording material has good image recording/erasing ability, and good durability.

40 Claims, 1 Drawing Sheet

REVERSIBLE THERMOSENSITIVE RECORDING MATERIAL

BACKGROUND OF THE INVENTION

1. Field of the Invention

The present invention relates to a reversible thermosensitive recording material, and more particularly to a reversible thermosensitive recording material which utilizes a coloring reaction of an electron donating coloring agent and an electron accepting coloring developer and in which a colored image is repeatedly formed and erased by appropriately heating and cooling the reversible thermosensitive recording material.

2. Discussion of the Related Art

A variety of thermosensitive recording materials are well known in which a colored image can be formed by a coloring reaction when an electron donating coloring agent is brought into contact with an electron accepting coloring developer while heat or the like is applied thereto.

The thermosensitive recording materials have the following advantages over other conventional recording materials:

(1) color images can be rapidly recorded by a relatively simple apparatus without using such complicated steps as developing and fixing;

(2) color images can be recorded without producing noise and environmental pollution;

(3) various color images, e.g., red, blue, violet and black, can be easily obtained;

(4) image density and background whiteness are high; and (5) the manufacturing cost is relatively low.

Because of these advantages, the above-described thermosensitive recording materials can be widely used, not only as a recording material for price labels in stores, but also as recording materials for copiers, printers for computers, facsimiles, automatic vending machines of tickets, video printers and measuring instruments.

However, the coloring reaction of these thermosensitive recording materials is irreversible and accordingly the used recording materials cannot be repeatedly used by erasing the recorded images.

Several thermosensitive recording materials which can reversibly form and erase an image have been proposed. For example, they are as follows:

(1) a thermosensitive recording material which includes gallic acid in combination with phloroglucinol serving as coloring developers (Japanese Laid-Open Patent Publication No. 60-193691);

(2) a thermosensitive recording material which includes phenolphthalein or Thymolphthalein serving as a coloring developer (Japanese Laid-Open Patent Publication No. 61-237684);

(3) a thermosensitive recording material which includes an uniform solid solution of a coloring agent, a coloring developer and a carboxylic acid ester (Japanese Laid-Open Patent Publications No. 62-138556, 62-138568 and 62-140881);

(4) a thermosensitive recording material which includes an ascorbic acid derivative serving as a coloring developer (Japanese Laid-Open Patent Publication No. 63-173684); and (5) a thermosensitive recording material which includes bis(hydroxyphenyl)acetic acid or a higher aliphatic amine salt of gallic acid serving as a coloring developer (Japanese Laid-Open Patent Publication No. 2-188294).

However, these reversible thermosensitive recording materials have one or more of the following drawbacks:

(1) at least one of (a) the stability of image formation and (b) the stability of image erasure is not satisfactory;

(2) the image density of the recorded image is not satisfactory; and (3) image qualities deteriorate after images are repeatedly formed and erased.

Therefore, these reversible thermosensitive recording materials are not in practical use.

In attempting to solve these problems, the present inventors have proposed a reversible thermosensitive recording material which includes a coloring agent such as a leuco dye and a coloring developer such as an organic phosphate compound having a long-chain aliphatic hydrocarbon group, an aliphatic carboxylic acid compound or a phenolic compound (Japanese Laid-Open Patent Publication No. 5-124360). The reversible thermosensitive recording material can stably repeat image formation and image erasure by being appropriately heated and cooled, and the image-recorded state or the image-erased state can be stably maintained in room temperature. Japanese Laid-Open Patent Publication No. 6-210954 has disclosed a reversible thermosensitive recording material which includes a specified phenolic compound (having a long-chain aliphatic hydrocarbon group) serving as a coloring developer, and is as good as the above-mentioned reversible thermosensitive recording material.

These reversible thermosensitive recording materials, however, have a drawback in that the image density deteriorates or the recording layer becomes deformed when images are repeatedly formed and erased in various environmental conditions of practical use of the recording materials. The reason for the problem is considered to be that the structures of the recording layer and the protective layer of the recording material are gradually changed and deteriorated by the mechanical force and the heat of a thermal printhead which applies heat to the recording material to form or erase images.

In attempting to solve this problem, a reversible thermosensitive recording material has been disclosed which has a recording layer including particles whose average particle diameter is more than 1.1 times the thickness of the recording layer (Japanese Laid-Open Patent Publication No. 6-340171). In addition, a reversible thermosensitive recording material has been disclosed which has good ability to be used with thermal printheads owing to the formation of a protective layer thereon which has specified gloss and surface smoothness (Japanese Laid-Open Patent Publication No. 8-156410). In addition, in attempting to provide a reversible thermosensitive recording material which can repeatedly and stably record and erase images, Japanese Laid-Open Patent Publications No. 5-124360 and 6-344659 respectively disclose a recording material including a crosslinked resin which is formed upon application of heat, ultraviolet light or electron beams, and a method to irradiate a recording layer with electron beams. However, these reversible thermosensitive recording materials cannot yet entirely improve the deterioration of the recording layer and the protective layer, resulting in occurrence of deformation of the recorded image when the recording materials are repeatedly used.

Because of these reasons, a need exists for a reversible thermosensitive recording material which has good abilities to repeatedly form and erase images and can maintain good image qualities such as good image contrast and good image sharpness without deformation of the recording material-even when the recording material repeatedly forms and erases images.

SUMMARY OF THE INVENTION

Accordingly, an object of the present invention is to provide a reversible thermosensitive recording material which has good abilities to repeatedly form and erase images and can maintain good image qualities such as good image contrast and good image sharpness without deformation of the recording material even when images are repeatedly formed and erased thereon.

Another object of the present invention is to provide a reversible thermosensitive recording material which can maintain good image contrast when the recording material is irradiated with light.

To achieve such objects, the present invention contemplates the provision of a reversible thermosensitive recording material which includes a recording layer including a resin, an isocyanate compound, an electron donating coloring agent and an electron accepting coloring developer and in which an image is reversibly formed and erased by appropriately heating and cooling the recording layer, wherein the resin includes a resin crosslinked with the isocyanate compound.

Preferably, the resin has a hydroxy group and is crosslinked with the isocyanate compound, and more preferably the resin includes at least one of acryl polyol resins, polyester polyol resins and polyurethane polyol resins.

In addition, the electron donating coloring agent preferably includes a fluoran compound and/or an azaphthalide compound, and the electron accepting coloring developer preferably includes a phenolic compound.

Further, the reversible thermosensitive recording material includes a protective layer which is formed overlying the recording layer and which includes a crosslinked resin.

These and other objects, features and advantages of the present invention will become apparent upon consideration of the following description of the preferred embodiments of the present invention taken in conjunction with the accompanying drawing.

DESCRIPTION OF THE PREFERRED EMBODIMENTS

Figure 1:
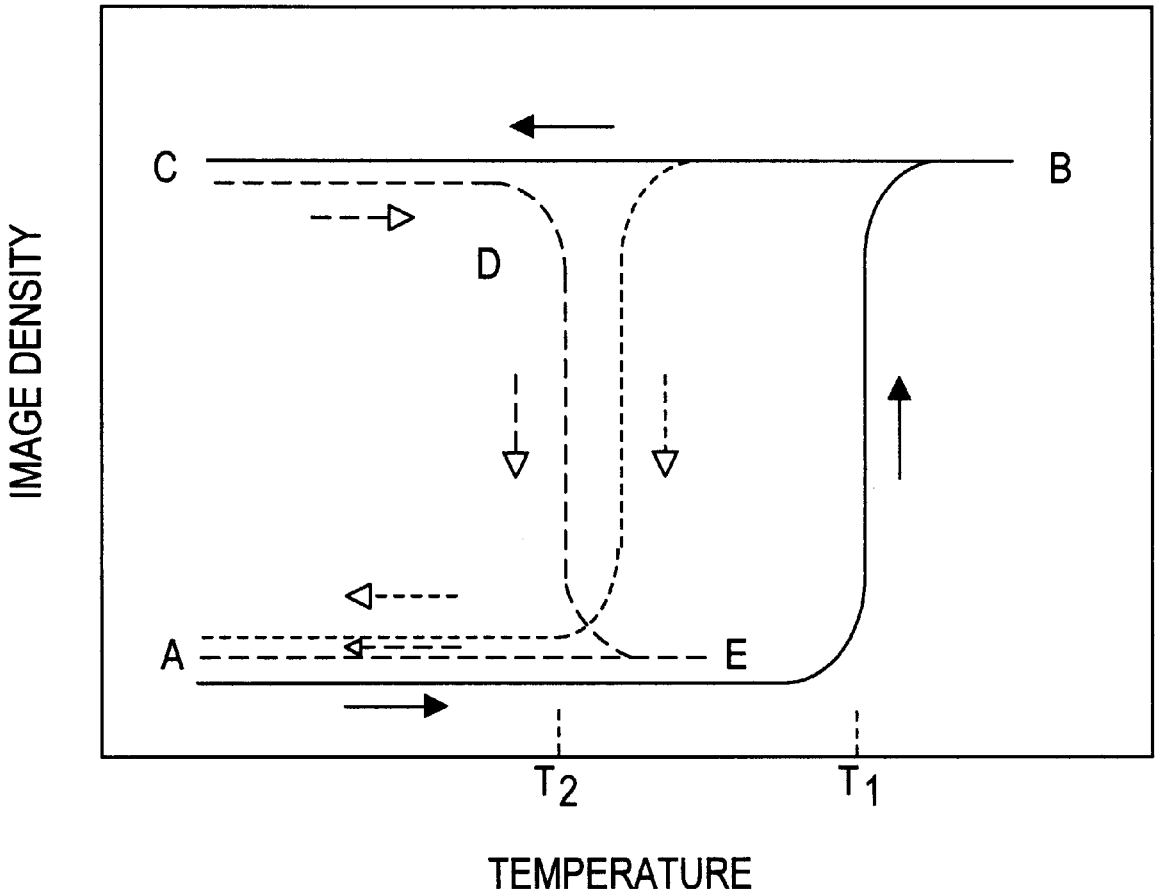
FIG. 1 is a graph illustrating the relationship between temperature and image density of a recording layer in an image recording and erasing cycle of a reversible thermosensitive recording material embodying, the present invention.

FIG. 1 is a graph illustrating the relationship between temperature of a recording material and image density thereof. When the recording material which is in a non-colored state A is heated, the recording material begins to color at a temperature T1 in which at least one of an electron donating coloring agent and an electron accepting coloring developer is melted and then achieves a melted colored state B. If the recording material in the melted colored state B is rapidly cooled to room temperature, the recording material keeps the colored state and becomes a cooled colored state C in which the electron donating coloring agent and the electron accepting coloring developer are almost solidified. It depends upon cooling speed whether the recording material keeps the colored state, and if the recording material is gradually cooled, the recording material returns to the non-colored state A (a dotted line B-A) or becomes a semi-colored state in which the image density of the recording material is relatively low compared to the image density of the recording material in the cooled colored state C. If the recording material in the cooled colored state C is heated again, the recording material begins to discolor at a temperature T2 lower than T1 and becomes a non-colored state E (a broken line C-D-E). If the recording material in the non-colored state E is cooled to room temperature, the recording material returns to the non-colored state A. The temperatures T1 and T2 depend on the materials of the coloring agent and the coloring developer. Accordingly, by appropriately selecting a coloring agent and a coloring developer, a recording material having desired T1 and T2 can be obtained. The image densities of the recording material in the colored states B and C are not necessarily the same.

In the colored state C, the recording layer includes the coloring agent and the coloring developer which form a solid in which a molecule of the coloring agent and a molecule of the coloring developer are mixed while contacting with each other. Namely, the coloring agent and the coloring developer cohere while they are reacting with each other, resulting in maintenance of the coloring state. It is considered that the colored state C is stable because the cohered structure of the coloring agent and the coloring developer is formed. On the other hand, in the non-colored state, at least one of the coloring agent and the coloring developer aggregates to form a domain, or crystallizes; thereby each phase of the coloring agent and the coloring developer is isolated from each other, and accordingly the recording material is stably in the non-colored state. In almost all the recording materials of the present invention, the cohered structure of the coloring agent and the coloring developer is changed to a state in which the phases of the coloring agent and the coloring developer are isolated from each other and the coloring developer crystallizes; thereby color erasure can be perfectly performed. Namely, in the color erasure process of going from the colored state B to the non-colored state A when the recording materials are gradually cooled or going from the colored state C to the non-colored state A via the states D and E in FIG. 1, this structure change occurs at a temperature T2.

The reversible thermosensitive recording material (referred to as a recording material) of the present invention has a substrate, a recording layer formed on the substrate and optionally a protective layer formed on the recording layer. The structure of the recording material of the present invention need not be limited to this structure. For example, the recording material may include an under-coat layer formed between the substrate and the recording layer, an intermediate layer formed between the recording layer and the protective layer, and a back-coat layer formed on the side of the substrate opposite to the side on which the recording layer is formed. In addition, the recording material may include a magnetic recording layer. The substrate and the above-mentioned layers may be colored. The recording layer includes a resin which is preferably crosslinked with an isocyanate compound, an electron donating coloring agent and an electron accepting coloring developer which reversibly records and erases an image when the recording layer is appropriately heated and cooled. The protective layer which preferably includes a crosslinked resin is preferably formed on the recording layer to make the recording material resistant to heat of a recording device such as a thermal printhead and to make the recording material and recorded images resistant to chemicals, water, light and rubbing.

The recording layer of the recording material of the present invention preferably includes a crosslinked resin which is crosslinked with an isocyanate compound.

Suitable crosslinkable resins include acryl polyol resins, polyester polyol resins and polyurethane polyol resins.

Among these resins, acryl polyol resins are preferable because of having good ability to form and erase images. In addition, among these acryl polyol resins, acryl polyol copolymers in which a monomer having a hydroxy group, a styrene monomer and a methyl methacrylate monomer are polymerized, and acryl polyol copolymers in which a monomer having a hydroxy group, a styrene monomer, a methyl methacrylate monomer and a butyl methacrylate monomer are polymerized are preferable. Specific examples of the monomer having a hydroxy group include 2-hydroxyethyl methacrylate, 2-hydroxypropyl methacrylate and the like. The butyl methacrylate is preferably iso-butyl methacrylate.

Acryl polyol resins for use in the recording layer of the recording material of the present invention preferably include a copolymer in which a monomer, which has a glass transition temperature lower than about 20° C. when only the monomer is polymerized, is copolymerized in an amount of less than about 10% by weight, and more preferably less than about 5% by weight, to obtain a recording material having good durability. The acryl polyol resins for use in the recording layer preferably include a copolymer in which a monomer, which has a glass transition temperature higher than about 20° C. when only the monomer is polymerized, is copolymerized in an amount of greater than about 70% by weight, and more preferably less than about 80% by weight, to obtain a recording material having good durability. The acryl polyol copolymer preferably has a glass transition temperature greater than 50° C., and more preferably greater than 70° C. to obtain a recording material having good durability. In addition, a monomer having a hydroxy group is preferably copolymerized in the acryl polyol copolymer in an amount of greater than about 20% by weight to obtain a recording material having good durability.

The molecular weight of the acryl polyol resins is preferably from about 5,000 to 200,000, and more preferably from about 7,000 to about 150,000.

When a coating liquid such as a protective layer coating liquid including an organic solvent or an ultraviolet crosslinkable resin is coated to form, for example, a protective layer on a recording layer which is formed by coating and drying a recording layer coating liquid including a coloring agent, a coloring developer and an organic solvent, the coloring agent tends to migrate to the top of the protective layer, resulting in undesired color formation of the protective layer caused by decomposition of the coloring agent by irradiation of light (particularly, ultraviolet light). In attempting to solve this problem, when a protective layer is formed by coating and drying an aqueous coating liquid, the protective layer tends to be peeled from the recording layer, which is caused by poor adhesion of the protective layer and the recording layer. The recording layer of the recording material of the present invention has good adhesion to the protective layer and can prevent the coloring agent from migrating to the protective layer.

In addition, when a layer such as a protective layer which includes an ultraviolet absorbing agent is formed overlying the recording layer of the recording material of the present invention, the resultant recording material has excellent light resistance.

Suitable crosslinking agents include isocyanate compounds which have a plurality of isocyanate groups. Specific examples of such isocyanate compounds include hexamethylene diisocyanate (HDI), tolylene diisocyanate (TDI), xylylene diisocyanate (XDI), isophorone diisocyanate (IPDI), adducts thereof with trimethylol propane or the like, buret type compounds thereof, isocyanurate type compounds thereof or blocked isocyanate compounds thereof. Among these isocyanate compounds, hexamethylene diisocyanate, adducts thereof, buret type compounds thereof and isocyanurate type compounds thereof are preferable.

The crosslinking agent is mixed with the resin so that the ratio of the functional group of the crosslinking agent to the active group of the resin is from about 0.01 to about 3 by mole, and preferably from about 0.1 to about 1 by mole, to maintain good heat resistance of the recording layer and good image formation/erasure properties.

In addition, the recording layer may include a crosslinking promoter which can be used as a catalyst for this kind of reaction. Specific examples of such a crosslinking promoter include tertiary amines such as 1, 4-diaza-bicyclo(2, 2, 2)octane, metal compounds such as organic tin compounds and the like.

In addition, all of the crosslinking agent added to the recording layer coating liquid need not necessarily react with the resin. Namely, a crosslinking agent part of which is not reacted with the resin may be included in the recording layer.

Suitable crosslinking conditions include a condition in which a recording material is preserved at a relatively low temperature such as room temperature for a long period of time or a condition in which a recording material is preserved at a relatively high temperature for a short period of time. Specific examples of such conditions include a condition of from 30 to 130° C. in temperature and from 1 minute to 150 hours in time, and preferably a condition of from 40 to 80° C. and from 1 to 100 hours to avoid coating defects of the layer to be coated on the recording layer and to maintain good adhesion of the recording layer and the layer to be coated thereon. In the crosslinking operation, the humidity of the preserving environment in which the recording material is preserved is preferably low.

When a polyethylene terephthalate (PET) film is used as a substrate of the recording material, the drying or crosslinking temperature is preferably less than 130° C. to avoid shrinking or deformation of the recording material.

The coloring agent in the recording layer preferably includes at least one of the leuco compounds having the following formula (1), (3) and (4) to form images having good image qualities and good resistance of the recorded images to light:

(1)

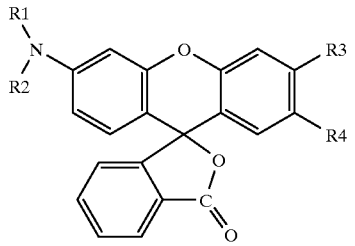

wherein R1 and R2independently represent a lower alkyl group, an aryl group, a substituted aryl group or a hydrogen atom, and R1 and R2 may combine with each other to form a ring; R3 represents a lower alkyl group, a halogen atom or a hydrogen atom; and R4 represents a lower alkyl group, a halogen atom, a hydrogen atom or a substituted anilino group having the following formula:

(2)

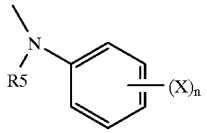

wherein R5 represents a lower alkyl group or a hydrogen atom; X represents a lower alkyl group or a halogen atom; and n is 0, 1, 2 or 3.

(3)

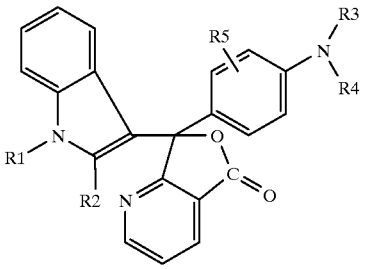

wherein R1, R2, R3 and R4 independently represent an alkyl group or a hydrogen atom; and R5 represents an alkyl group, an alkoxy group or a hydrogen atom.

(4)

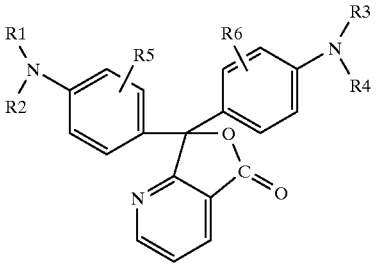

wherein R1, R2, R3 and R4 independently represent a lower alkyl group or a hydrogen atom; and R5 and R6 independently represent an alkyl group, an alkoxy group or a hydrogen atom.

Specific examples of leuco compounds for use as a coloring agent in the recording layer of the recording material of the present invention include, but are not limited to:

2-anilino-3-methyl-6-diethylaminofluoran,
2-anilino-3-methyl-6-(di-n-butylamino)fluoran,
2-anilino-3-methyl-6-(N-n-propyl-N-methylamino)fluoran,
2-anilino-3-methyl-6-(N-isopropyl-N-methylamino)fluoran,
2-anilino-3-methyl-6-(N-isobutyl-N-methylamino)fluoran,
2-anilino-3-methyl-6-(N-n-amyl-N-methylamino)fluoran,
2-anilino-3-methyl-6-(N-sec-butyl-N-ethylamino)fluoran,
2-anilino-3-methyl-6-(N-n-amyl-N-ethylamino)fluoran,
2-anilino-3-methyl-6-(N-n-isoamyl-N-ethylamino)fluoran,
2-anilino-3-methyl-6-(N-n-propyl-N-isopropylamino) fluoran,
2-anilino-3-methyl-6-(N-cyclohexyl-N-methylamino) fluoran,
2-anilino-3-methyl-6-(N-ethyl-p-toluidino)fluoran,
2-anilino-3-methyl-6-(N-methyl-p-toluidino)fluoran,
2-(m-trichloromethylanilino)-3-methyl-6-diethylaminofluoran,
2-(m-trifluoromethylanilino)-3-methyl-6-diethylaminofluoran,
2-(m-trifluoromethylanilino)-3-methyl-6-(N-cyclohexyl-N-methylamino)fluoran,
2-(2, 4-dimethylanilino)-3-methyl-6-diethylaminofluoran,
2-(N-ethyl-p-toluidino)-3-methyl-6-(N-ethylanilino) fluoran,
2-(N-methyl-p-toluidino)-3-methyl-6-(N-propyl-p-toluidino)fluoran,
2-anilino-6-(N-n-hexyl-N-ethylamino)fluoran,
2-(o-chloroanilino)-6-diethylaminofluoran,
2-(o-chloroanilino)-6-dibutylaminofluoran,
2-(m-trifluoromethylanilino)-6-diethylaminofluoran,
2, 3-dimethyl-6-dimethylaminofluoran,
3-methyl-6-(N-ethyl-p-toluidino)fluoran,
2-chloro-6-diethylaminofluoran,
2-bromo-6-diethylaminofluoran,
2-chloro-6-dipropylaminofluoran,
3-chloro-6-cyclohexylaminofluoran,
3-bromo-6-cyclohexylaminofluoran,
2-chloro-6-(N-ethyl-N-isoamylamino)fluoran,
2-chloro-3-methyl-6-diethylaminofluoran,
2-anilino-3-chloro-6-diethylaminofluoran,
2-(o-chloroanilino)-3-chloro-6-cyclohexylaminofluoran,
2-(m-trifluoromethylanilino)-3-chloro-6-diethylaminofluoran,
2-(2, 3-dichloroanilino)-3-chloro-6-diethylaminofluoran,
1, 2-benzo-6-diethylaminofluoran,
3-diethylamino-6-(m-trifluoromethylanilino)fluoran,
3-(1-ethyl-2-methylindole-3-yl)-3-(2-methyl-4-diethylaminophenyl)-4-azaphthalide,
3-(1-ethyl-2-methylindole-3-yl)-3-(2-methyl-4-diethylaminophenyl)-7-azaphthalide,
3-(1-ethyl-2-methylindole-3-yl)-3-(4-diethylaminophenyl)-4-azaphthalide,
3-(1-ethyl-2-methylindole-3-yl)-3-(4-N-n-amyl-N-methylaminophenyl)-4-azaphthalide, and
3-(1-methyl-2-methylindole-3-yl)-3-(2-hexyloxy-4-diethylaminophenyl)-4-azaphthalide, The coloring agent for use in the recording layer of the present invention may include conventional leuco dyes. Specific examples of such conventional leuco dyes which are employed alone or in combination include:

2-(p-acetylanilino)-6-(N-n-amyl-N-n-butylamino)fluoran,
2-benzylamino-6-(N-ethyl-p-toluidino)fluoran,
2-benzylamino-6-(N-methyl-2, 4-dimethylanilino)fluoran,
2-benzylamino-6-(N-ethyl-2, 4-dimethylanilino)fluoran,
2-dibenzylamino-6-(N-methyl-p-toluidino)fluoran,
2-dibenzylamino-6-(N-ethyl-p-toluidino)fluoran,
2-(di-p-methylbenzylamino)-6-(N-ethyl-p-toluidino) fluoran,
2-(α-phenylethylamino)-6-(N-ethyl-p-toluidino)fluoran,
2-methylamino-6-(N-methylanilino)fluoran,
2-methylamino-6-(N-ethylanilino)fluoran,
2-methylamino-6-(N-propylanilino)fluoran,
2-ethylamino-6-(N-methyl-p-toluidino)fluoran,
2-methylamino-6-(N-methyl-2, 4-dimethylanilino)fluoran,
2-ethylamino-6-(N-methyl-2, 4-dimethylanilino)fluoran,
2-dimethylamino-6-(N-methylanilino)fluoran,
2-dimethylamino-6-(N-ethylanilino)fluoran,
2-diethylamino-6-(N-methyl-p-toluidino)fluoran,
2-diethylamino-6-(N-ethyl-p-toluidino)fluoran,
2-dipropylamino-6-(N-methylanilino)fluoran,
2-dipropylamino-6-(N-ethylanilino)fluoran,
2-amino-6-(N-methylanilino)fluoran,
2-amino-6-(N-ethylanilino)fluoran,
2-amino-6-(N-propylanilino)fluoran, 2-amino-6-(N-methyl-p-toluidino)fluoran
2-amino-6-(N-ethyl-p-toluidino)fluoran,
2-amino-6-(N-propyl-p-toluidino)fluoran,
2-amino-6-(N-methyl-p-ethylanilino)fluoran,
2-amino-6-(N-ethyl-p-ethylanilino)fluoran,
2-amino-6-(N-propyl-p-ethylanilino)fluoran,
2-amino-6-(N-methyl-2, 4-dimethylanilino)fluoran,
2-amino-6-(N-ethyl-2, 4-dimethylanilino)fluoran,
2-amino-6-(N-propyl-2, 4-dimethylanilino)fluoran,
2-amino-6-(N-methyl-p-chloroanilino)fluoran,
2-amino-6-(N-ethyl-p-chloroanilino)fluoran,
2-amino-6-(N-propyl-p-chloroanilino)fluoran,
1, 2-benzo-6-diethylaminofluoran,
1, 2-benzo-6-(N-ethyl-N-isoamylamino)fluoran,
1, 2-benzo-6-dibutylaminofluoran,
1, 2-benzo-6-(N-ethyl-N-cyclohexylamino)fluoran,
1, 2-benzo-6-(N-ethyl-p-toluidino)fluoran,
2-anilino-3-methyl-6-(N-2-ethoxypropyl-N-ethylamino) fluoran,
2-(p-chloroanilino)-6-(N-n-octylamino)fluoran,
2-(p-chloroanilino)-6-(N-n-palmitylamino)fluoran,
2-(p-chloroanilino)-6-(di-n-octylamino)fluoran,
2-benzoylamino-6-(N-ethyl-p-toluidino)fluoran,
2-(o-methoxybenzoylamino)-6-(N-ethyl-p-toluidino) fluoran,
2-dibenzylamino-4-methyl-6-diethylaminofluoran,
2-dibenzylamino-4-methoxy-6-(N-methyl-p-toluidino) fluoran,
2-dibenzylamino-4-methyl-6-(N-ethyl-p-toluidino)fluoran,
2-(α,-phenylethylamino)-4-methyl-6-diethylaminofluoran,
2-(p-toluidino)-3-(t-butyl)-6-(N-methyl-p-toluidino) fluoran,
2-(o-methoxycarbonylanilino)-6-diethylaminofluoran,
2-acetylamino-6-(N-methyl-p-toluidino)fluoran,
3-diethylamino-6-(m-trifluoromethylanilino)fluoran,
4-methoxy-6-(N-ethyl-p-toluidino)fluoran,
2-ethoxyethylamino-3-chloro-6-dibutylaminofluoran,
2-benzylamino-4-chloro-6-(N-ethyl-p-toluidino)fluoran,
2-(α-phenylethylamino)-4-chloro-6-diethylaminofluoran,
2-(N-benzyl-p-trifluoromethylanilino)-4-chloro-6-diethylaminofluoran,
2-anilino-3-methyl-6-pyrrolidinofluoran,
2-anilino-3-chloro-6-pyrrolidinofluoran,
2-anilino-3-methyl-6-(N-ethyl-N-tetrahydrofurfurylamino) fluoran,
2-mesidino-4', 5'-benzo-6-diethylaminofluoran,
2-(m-trifluoromethylanilino)-3-methyl-6-pyrrolidino fluoran,
2-(α-naphthylamino)-3, 4-benzo-4'-bromo-6-(N-benzyl-N-cyclohexylamino)fluoran,
2-piperidino-6-diethylaminofluoran,
2-(N-n-propyl-p-trifluoromethylanilino)-6-morpholino fluoran,
2-(di-N-p-chlorophenyl-methylamino)-6-pyrrolidino fluoran,
2-(N-n-propyl-m-trifluoromethylanilino)-6-morpholino fluoran,
1, 2-benzo-6-(N-ethyl-N-n-octylamino)fluoran,
1, 2-benzo-6-diallylaminofluoran,
1, 2-benzo-6-(N-ethoxyethyl-N-ethylamino)fluoran,
benzoleucomethyleneblue,
2-{3, 6-bis(diethylamino)}-6-(o-chloroanilino)xanthyl benzoic acid lactam,
2-{3, 6-bis(diethylamino)}-9-(o-chloroanilino)xanthyl benzoic acid lactam,
3, 3-bis(p-dimethylaminophenyl)phthalide,
3, 3-bis(p-dimethylaminophenyl)-6-dimethylaminophthalide (i.e., crystal violet lactone)
3, 3-bis(p-diethylaminophenyl)-6-diethylaminophthalide,
3, 3-bis(p-dimethylaminophenyl)-6-chlorophthalide,
3, 3-bis(p-dibutylaminophenyl) phthalide,
3-(2-methoxy-4-dimethylaminophenyl)-3-(2-hydroxy-4,5-dichiorophenyl)phthalide,
3-(2-hydroxy-4-dimethylaminophenyl)-3-(2-methoxy-5-chlorophenyl)phthalide,
3-(2-hydroxy-4-dimethoxyaminophenyl)-3-(2-methoxy-5-chlorophenyl)phthalide,
3-(2-hydroxy-4-dimethylaminophenyl)-3-(2-methoxy-5-nitrophenyl)phthalide,
3-(2-hydroxy-4-diethylaminophenyl)-3-(2-methoxy-5-methylphenyl)phthalide,
3-(2-methoxy-4-dimethylaminophenyl)-3-(2-hydroxy-4-chloro-5-methoxyphenyl)phthalide,
3, 6-bis(dimethylamino)fluorenespiro(9, 3')-6'-dimethylaminophthalide,
3-(1-ethyl-2-methylindole-3-yl)-3-(2-ethoxy-4-diethylaminophenyl)-4-azaphthalide,
3-(1-octyl-2-methylindole-3-yl)-3-(2-ethoxy-4-diethylaminophenyl)-4-azaphthalide,
3-(1-ethyl-2-methylindole-3-yl)-3-(2-ethoxy-4-diethylaminophenyl)-7-azaphthalide,
3, 3-bis(2-ethoxy-4-diethylaminophenyl)-4-azaphthalide,
3, 3-bis(2-ethoxy-4-diethylaminophenyl)-7-azaphthalide,
6'-chloro-8'-methoxy-benzoindolino-spiropyran, and
6'-bromo-2'-methoxy-benzoindolino-spiropyran.

Next, a coloring developer which can be employed in the recording layer in combination with the aforementioned coloring agent, i.e., the leuco dye, is described hereinafter.

Suitable coloring developers for use in the recording layer, which have been disclosed in Japanese Laid-Open Patent Publication No. 5-124360, include compounds such as phosphate compounds having a long-chain hydrocarbon group, aliphatic carboxylic acid compounds or phenolic compounds. Coloring developers preferably have both a structure capable of developing the coloring agent and a structure capable of controlling cohesion of the molecules thereof. Specific examples of the structure capable of developing the coloring agent include acidic groups such as phenolic hydroxide groups, carboxyl groups, phosphate groups, and other groups which can make the coloring agent colored such as thiourea groups or metal salts of carboxylic acids. Specific examples of the structure capable of controlling cohesion of the molecules thereof include long-chain hydrocarbon groups such as long-chain alkyl groups. The hydrocarbon groups preferably have eight or more carbon atoms to obtain good image formation/erasure properties of the recording material. The hydrocarbon groups may include unsaturated or branched hydrocarbon groups which preferably have a main chain having eight or more carbon atoms. In addition, the hydrocarbon groups may be substituted with a halogen atom, a hydroxide group, an alkoxy group or the like and may include a divalent group such as aromatic rings or divalent groups including a heteroatom in the chain thereof.

As mentioned above, the coloring developers include a structure in which a structure capable of developing the coloring agent and a structure capable of controlling cohesion are connected. The connection part may include one or more divalent groups including a heteroatom, or a group in which a plurality of divalent groups are combined. In addition, the connection part of the coloring developer may include one or more of aromatic groups and heterocyclic rings such as a phenylene group, a naphthylene group and the like.

Specific examples of such coloring developers are hereinafter described. The coloring developers are employed alone or in combination.

The following phenolic compounds are preferably used as the coloring developer in the recording layer of the recording material of the present invention to obtain a recording material having good ability to form and erase images.

Suitable phenolic compounds include phenolic compounds having the following formula (5):

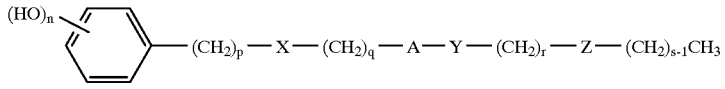

(5)

wherein p, q and r are independently 0 or an integer, s is an integer, A, X, Y and Z independently represent a divalent group or a direct bonding and n is an integer of from 1 to 3.

Specific examples of such compounds having the formula (5) include compounds shown in Table 1 in which each number or structure of the characters, p, q, r, s, X, A, Y and Z, of the compounds is described. In each example in Table 1, n is an integer of from 1 to 3, and the phenolic group includes a phenyl group having one or more hydroxy groups such as 4-hydroxyphenyl, 3-hydroxyphenyl, 2-hydroxyphenyl, 2, 4-dihydroxyphenyl, 3, 4-dihydroxyphenyl or 3, 4, 5-trihydroxyphenyl groups. This phenyl group may include a substituent other than a hydroxy group. In addition, this phenyl group can be replaced with another aromatic ring having a phenolic hydroxy group.

TABLE 1

| p | X | q | A | Y | r | Z | s |
|---|---|---|---|---|---|---|---|
| 0 | NHCO | 0 | — | — | 0 | — | 21 |
| 2 | NHCO | 0 | — | — | 0 | — | 18 |
| 2 | NHCO | 1 | — | NHCONH | 0 | — | 16 |
| 0 | NHCO | 1 | — | NHCO | 0 | — | 19 |
| 0 | NHCO | 1 | — | NHCOCONH | 0 | — | 18 |
| 0 | NHCO | 1 | — | NHCO | 3 | NHCONH | 18 |
| 2 | NHCO | 2 | — | CONH | 0 | — | 18 |
| 0 | NHCO | 5 | — | NHCONH | 0 | — | 18 |
| 0 | NHCO | 10 | | NHCOCONH | 0 | — | 14 |
| 0 | NHCO | 2 | — | CONHNHCO | 0 | — | 17 |
| 2 | NHCO | 10 | — | CONHCONH | 0 | — | 16 |
| 0 | NHCO | 7 | — | NHCONHCO | 0 | — | 11 |
| 0 | NHCO | 6 | — | CONHNHCONH | 0 | — | 18 |
| 2 | NHCO | 11 | — | NHCONHNHCO | 0 | — | 17 |
| 0 | NHCO | 3 | — | NHCONHNH | 0 | — | 18 |
| 0 | NHCO | 5 | — | $SO_2$ | 0 | — | 18 |
| 0 | NHCO | 5 | — | NHCO | 5 | NHCONH | 14 |
| 2 | NHCO | 11 | — | CONH | 1 | CONHNHCO | 13 |
| 0 | NHCO | 1 | p-phenylene | O | 0 | — | 18 |
| 0 | NHCO | 2 | p-phenyleue | NHCONH | 0 | — | 18 |
| 0 | NHCO | 4 | — | OCO | 0 | — | 15 |
| 0 | NHCO | 6 | — | SCO | 0 | — | 17 |
| 2 | NHCO | 2 | — | OCONH | 0 | — | 14 |
| 0 | NHCO | 10 | — | S | 0 | — | 20 |
| 1 | CONH | 6 | — | $SO_2$ | 0 | — | 21 |
| 2 | CONH | 3 | — | COO | 0 | — | 18 |
| 1 | CONH | 1 | — | NHCO | 0 | — | 19 |
| 2 | CONH | 2 | — | CONH | 0 | — | 18 |
| 2 | CONH | 5 | — | NHCONH | 0 | — | 18 |
| 1 | CONH | 10 | — | NHCOCONH | 0 | — | 14 |
| 2 | CONH | 2 | — | CONHNHCO | 0 | — | 17 |
| 2 | CONH | 10 | — | CONHCONH | 0 | — | 16 |
| 3 | CONH | 7 | — | NHCONHCO | 0 | — | 11 |
| 1 | NHCONH | 6 | — | CONHNHCONH | 0 | — | 18 |
| 2 | NHCONH | 11 | — | NHCOCONH | 0 | — | 16 |
| 2 | NHCONH | 3 | — | CONH | 0 | — | 18 |
| 1 | NHCONH | 5 | — | $SO_2$ | 0 | — | 18 |
| 2 | NHCONH | 5 | — | CONHNHCO | 5 | NHCONH | 18 |
| 2 | CONHNHCO | 11 | — | NHCO | 0 | — | 14 |
| 1 | CONHNHCO | 6 | — | O | 6 | NHCOCONH | 18 |
| 2 | CONHNHCO | 2 | p-phenylene | NHCONH | 0 | — | 18 |
| 2 | COO | 1 | — | NHCO | 0 | — | 19 |
| 1 | COO | 5 | — | NHCONH | 0 | — | 18 |
| 2 | COO | 2 | — | CONHNHCO | 0 | — | 17 |
| 2 | COO | 7 | — | NHCONHCO | 0 | — | 11 |
| 2 | COO | 11 | — | NHCONHNHCO | 0 | — | 17 |
| 2 | COO | 3 | — | NHCONHNH | 0 | — | 18 |
| 1 | COO | 5 | — | $SO_2$ | 0 | — | 18 |
| 2 | COO | 11 | — | CONH | 1 | CONHNHCO | 14 |
| 2 | COO | 2 | p-phenylene | NHCONH | 0 | — | 18 |
| 3 | SCO | 5 | — | NHCONH | 0 | — | 18 |
| 2 | COS | 10 | — | NHCOCONH | 0 | — | 14 |
| 6 | SCO | 2 | — | NHCONHNHCO | 0 | — | 17 |
| 2 | COS | 10 | — | NHCONHCO | 0 | — | 16 |
| 2 | CONH | 7 | — | CONHNHCO | 0 | — | 11 |
| 1 | CONH | 6 | — | CONHNHCONH | 0 | — | 18 |
| 2 | CONH | 2 | — | NHCONHNHCO | 0 | — | 17 |
| 2 | CONH | 3 | — | NHCONHNH | 0 | — | 18 |
| 3 | CONH | 5 | — | $SO_2$ | 0 | — | 18 |
| 1 | CONH | 6 | — | NHCO | 5 | NHCONH | 18 |
| 2 | CONH | 11 | — | CONH | 1 | — | 14 |
| 2 | CONH | 4 | — | O | 0 | NHCOCONH | 18 |
| 1 | CONH | 2 | p-phenylene | NHCONH | 0 | — | 18 |
| 1 | NHCOCONH | 10 | — | CONH | 0 | — | 22 |
| 2 | NHCOCONH | 3 | — | $SO_2$ | 0 | — | 18 |
| 2 | OCONH | 4 | — | NHCO | 0 | — | 19 |
| 2 | NHCOO | 2 | — | CONH | 0 | — | 18 |
| 3 | OSONH | 5 | — | NHCONH | 0 | — | 18 |
| 2 | $NHSO_2$ | 10 | — | NHCOCONH | 0 | — | 14 |
| 1 | $NHSO_2$ | 2 | — | CONHNHCO | 0 | — | 17 |
| 2 | NHSOO | 7 | — | NHCONHCO | 0 | — | 11 |
| 3 | $SO_2$ | 6 | — | CONHNHCONH | 0 | — | 18 |
| 2 | $SO_2$ | 11 | — | NHCONHNHCO | 0 | — | 17 |
| 1 | $SO_2$ | 3 | — | NHCONHNH | 0 | — | 18 |
| 2 | NHCO | 1 | — | NHCOCONH | 0 | — | 16 |
| 2 | NHCO | 1 | — | NHCONH | 0 | — | 14 |
| 1 | CONHNHCO | 1 | — | NHCONHNH | 0 | — | 18 |

TABLE 1-continued

| p | X | q | A | Y | r | Z | s |
|---|---|---|---|---|---|---|---|
| 2 | CONHNHCO | 1 | — | $NHSO_2$ | 0 | — | 18 |
| 2 | NHCONHCO | 1 | — | NHCONHCO | 0 | — | 17 |
| 1 | NHCONHCO | 1 | — | NHCO | 10 | NHCONH | 18 |
| 2 | CONHCO | 1 | — | NHNHCONH | 0 | — | 12 |
| 0 | CONHCONH | 8 | — | $SO_2$ | 0 | — | 18 |
| 0 | CONHCONH | 5 | — | NHCO | 5 | NHCONH | 18 |
| 0 | CONHCONH | 11 | — | CONH | 0 | — | 14 |
| 0 | CONHCONH | 2 | p-phenylene | O | 0 | — | 18 |
| 0 | CONHCONH | 2 | p-phenylene | S | 0 | — | 18 |
| 0 | CONHCONH | 2 | p-phenylene | COO | 0 | — | 21 |
| 0 | CH═N | 10 | — | NHCOCONH | 0 | — | 18 |
| 0 | CH═N | 1 | — | NHCONH | 0 | — | 20 |
| 0 | CH═N | 2 | p-phenylene | CONH | 0 | — | 18 |
| 0 | CONH | 0 | — | — | 0 | — | 22 |
| 0 | COO | 0 | — | — | 0 | — | 16 |
| 0 | S | 0 | — | — | 0 | — | 18 |
| 0 | $NHSO_2$ | 0 | — | — | 0 | — | 14 |
| 0 | $SO_2$ | 0 | — | — | 0 | — | 18 |
| 0 | O | 0 | — | — | 0 | — | 20 |
| 0 | OCOO | 0 | — | — | 0 | — | 18 |
| 0 | $SO_2NH$ | 0 | — | — | 0 | — | 18 |
| 0 | NHCONH | 0 | — | — | 0 | — | 18 |
| 0 | COS | 0 | — | — | 0 | — | 14 |
| 0 | SCO | 0 | — | — | 0 | — | 17 |
| 0 | $NHSO_2$ | 0 | — | — | 0 | — | 18 |
| 0 | NHCOO | 0 | — | — | 0 | — | 22 |
| 0 | NHSONH | 0 | — | — | 0 | — | 18 |
| 0 | N═CH | 0 | — | — | 0 | — | 17 |
| 0 | CO | 0 | — | — | 0 | — | 15 |
| 0 | CONHNHCO | 0 | — | — | 0 | — | 18 |
| 0 | OCO | 0 | | — | 0 | — | 17 |
| 0 | OCONH | 0 | — | — | 0 | — | 16 |
| 0 | SCOO | 0 | — | — | 0 | — | 14 |
| 0 | SCONH | 0 | — | — | 0 | — | 18 |
| 0 | NHCOCONH | 0 | — | — | 0 | — | 18 |
| 1 | NHCO | 0 | — | — | 0 | — | 17 |
| 3 | NHCO | 0 | — | — | 0 | — | 15 |
| 2 | NHCONH | 0 | — | — | 0 | — | 18 |
| 1 | NHCONH | 0 | — | — | 0 | — | 16 |
| 4 | CONHNHCO | 0 | — | — | 0 | — | 17 |
| 2 | CONHNHCO | 0 | — | — | 0 | — | 21 |
| 2 | NHCOCONH | 0 | — | — | 0 | — | 18 |
| 2 | CONHCONH | 0 | — | — | 0 | — | 20 |
| 2 | OCONH | 0 | — | — | 0 | — | 18 |
| 0 | NHCO | 0 | p-phenylene | O | 0 | — | 22 |
| 0 | NHCO | 0 | p-phenylene | NHCONH | 0 | — | 18 |
| 0 | CONH | 0 | p-phenylene | CONH | 0 | — | 18 |
| 0 | CONH | 0 | p-phenylene | CONHNHCO | 0 | — | 17 |
| 0 | $NHSO_2$ | 0 | p-phenylene | NHCO | 0 | — | 19 |
| 0 | S | 0 | p-phenylene | CONH | 0 | — | 18 |
| 0 | S | 0 | p-phenylene | NHCOO | 0 | — | 18 |
| 0 | S | 0 | p-phenylene | NHCOCONH | 0 | — | 16 |
| 0 | NHCONH | 0 | p-phenylene | NHCONH | 0 | — | 14 |
| 0 | NHCONH | 0 | p-phenylene | CONHNHCO | 0 | — | 17 |
| 0 | CH═N | 0 | p-phenylene | CONHCONH | 0 | — | 16 |
| 0 | N═CH | 0 | p-phenylene | S | 0 | — | 18 |
| 0 | NHCSNH | 0 | p-phenylene | COO | 0 | — | 20 |
| 0 | S | 1 | p-phenylene | NHCONH | 0 | — | 18 |
| 0 | S | 2 | p-phenylene | NHCONHNH | 0 | — | 18 |
| 0 | NHCO | 1 | p-phenylene | NHCONHCO | 0 | — | 19 |
| 0 | NHCO | 2 | p-phenylene | NHCO | 0 | — | 17 |
| 0 | CONH | 2 | p-phenylene | OCONH | 0 | — | 18 |
| 0 | CONH | 1 | p-phenylene | CONHNHCO | 0 | — | 17 |
| 0 | CONH | 1 | — | NHCO | 0 | — | 21 |
| 0 | CONH | 2 | — | NHCONH | 0 | — | 18 |
| 0 | S | 2 | — | NHCONH | 0 | — | 19 |
| 0 | S | 10 | — | NHCONH | 0 | — | 18 |
| 0 | S | 2 | — | CONHNHCO | 0 | — | 17 |
| 0 | S | 2 | — | CONHNHCONH | 0 | — | 14 |
| 0 | S | 1 | — | CONH | 0 | NHCONH | 18 |
| 0 | S | 2 | — | CONH | 1 | NHCO | 17 |
| 1 | CONH | 1 | — | NHCO | 0 | — | 17 |
| 2 | CONH | 1 | — | NHCONH | 0 | — | 18 |
| 0 | NHCO | 1 | — | CONH | 0 | — | 18 |
| 0 | NHCO | 1 | — | CONHNHCO | 0 | — | 17 |
| 0 | CONHNHCO | 2 | — | S | 0 | — | 12 |
| 0 | CONHNHCO | 10 | — | S | 0 | — | 10 |

TABLE 1-continued

| p | X | q | A | Y | r | Z | s |
|---|---|---|---|---|---|---|---|
| 2 | CONHNHCO | 2 | — | S | 0 | — | 14 |
| 0 | S | 10 | — | CONHNHCO | 2 | — | 18 |
| 0 | $SO_2$NHCONH | 2 | p-phenylene | NHCONH | 0 | — | 18 |
| 0 | $SO_2$NHCONH | 0 | p-phenylene | COO | 0 | — | 18 |
| 0 | $SO_2$ | 10 | — | NHCONH | 0 | — | 18 |
| 0 | $SO_2$ | 6 | — | CONHNHCO | 0 | — | 19 |
| 0 | $SO_2$ | 0 | p-phenylene | CONHNHCO | 0 | — | 18 |

The following organic phosphate compounds or carboxylic acid compounds can also be employed as the coloring developer in the recording layer of the recording material of the present invention.

organic phosphate compounds dodecyl phosphonate, tetradecyl phosphonate, hexadecyl phosphonate, octadecyl phosphonate, eicosyl phosphonate, docosyl phosphonate, tetracosyl phosphonate, ditetradecyl phosphate, dihexadecyl phosphate, dioctadecyl phosphate, dieicosyl phosphate and dibehenyl phosphate;

aliphatic carboxylic acid compounds 2-hydroxy tetradecanoic acid, 2-hydroxy hexadecanoic acid, 2-hydroxy octadecanoic acid, 2-hydroxy eicosanoic acid, 2-hydroxy docosanoic acid, 2-bromo hexadecanoic acid, 2-bromo octadecanoic acid, 2-bromo eicosanoic acid, 2-bromo docosanoic acid, 3-bromo octadecanoic acid, 3-bromo docosanoic acid, 2, 3-dibromo octadecanoic acid, 2-fluoro dodecanoic acid, 2-fluoro tetradecanoic acid, 2-fluoro hexadecanoic acid, 2-fluoro octadecanoic acid, 2-fluoro eicosanoic acid, 2-fluoro docosanoic acid, 2-iodo hexadecanoic acid, 2-iodo octadecanoic acid, 3-iodo hexadecanoic acid, 3-iodo octadecanoic acid and perfluoro octadecanoic acid; and aliphatic dicarboxylic acid compounds and aliphatic tricarboxylic acid compounds 2-dodecyloxy succinate, 2-tetradecyloxy succinate, 2-hexadecyloxy succinate, 2-octadecyloxy succinate, 2-eicosyloxy succinate, 2-docosyloxy succinate, 2-dodecylthio succinate, 2-tetradecylthio succinate, 2-hexadecylthio succinate, 2-octadecylthio succinate, 2-eicosylthio succinate, 2-docosylthio succinate, 2-tetracosylthio succinate, 2-hexadecyldithio succinate, 2-octadecyldithio succinate, 2-eicosyldithio succinate, dodecyl succinate, tetradecyl succinate, pentadecyl succinate, hexadecyl succinate, octadecyl succinate, eicosyl succinate, docosyl succinate, 2, 3-dihexadecyl succinate, 2, 3-dioctadecyl succinate, 2-methyl-3-hexadecyl succinate, 2-methyl-3-octadecyl succinate, 2-octadecyl-3-hexadecyl succinate, hexadecyl malonate, octadecyl malonate, eicosyl malonate, docosyl malonate, dihexadecyl malonate, dioctadecyl malonate, didocosyl malonate, methyloctadecyl malonate, 2-hexadecyl glutarate, 2-octadecyl glutarate, 2-eicosyl glutarate, docosyl glutarate, 2-pentadecyl adipate, 2-octadecyl adipate, 2-eicosyl adipate, 2-docosyl adipate, 2-hexadecanoyloxy propane-1, 2, 3-tricarboxylic acid and 2-octadecanoyloxy propane-1, 2, 3-tricarboxylic acid.

Carboxylic acid compounds for use as a coloring developer also include compounds having the following formula (6):

$$HOC(=O)-(CH_2)_p-A-(CH_2)_q-X-B-(CH_2)_r-Y-(CH_2)_{s-1}CH_3 \quad (6)$$

wherein p, q and r independently represent 0 or an integer, s is an integer and A, B, X and Y independently represent a divalent group or a direct bonding.

Specific examples of such compounds having the formula (6) include compounds shown in Table 2 in which each number or structure of the characters, p, q, r, s, A, B, X and Y, of the compounds is described.

TABLE 2

| p | A | q | X | B | r | Y | S |
|---|---|---|---|---|---|---|---|
| 0 | — | 0 | CO | — | 0 | — | 12 |
| 0 | — | 0 | CO | — | 0 | — | 16 |
| 0 | — | 0 | CO | — | 0 | — | 18 |
| 1 | — | 0 | CO | — | 0 | — | 14 |
| 1 | — | 0 | CO | — | 0 | — | 18 |
| 1 | — | 0 | CO | — | 0 | — | 22 |
| 2 | — | 0 | CO | — | 0 | — | 16 |
| 1 | — | 0 | $SO_2$ | — | 0 | — | 14 |
| 2 | — | 0 | $SO_2$ | — | 0 | — | 18 |
| 2 | — | 0 | $SO_2$ | — | 0 | — | 20 |
| 4 | — | 0 | $SO_2$ | — | 0 | — | 18 |
| 5 | — | 0 | $SO_2$ | — | 0 | — | 11 |
| 6 | — | 0 | $SO_2$ | — | 0 | — | 18 |
| 3 | — | 0 | $SO_2$ | — | 4 | S | 12 |
| 2 | — | 0 | $SO_2$ | p-phenylene | 0 | S | 10 |
| 1 | — | 0 | $SO_2$ | — | 3 | $SO_2$ | 16 |
| 4 | — | 0 | $SO_2$ | — | 10 | CONH | 6 |
| 2 | — | 0 | $SO_2$ | p-phenylene | 0 | CONH | 18 |
| 3 | — | 0 | $SO_2$ | — | 3 | $SO_2$NH | 16 |
| 1 | — | 0 | $SO_2$ | — | 6 | OCO | 10 |
| 4 | — | 0 | $SO_2$ | — | 10 | NHCO | 14 |
| 2 | — | 0 | $SO_2$ | — | 2 | $NHSO_2$ | 18 |

TABLE 2-continued

| p | A | q | X | B | r | Y | S |
|---|---|---|---|---|---|---|---|
| 2 | — | 0 | $SO_2$ | — | 6 | NHCONH | 14 |
| 2 | — | 0 | $SO_2$ | p-phenylene | 0 | NHCONH | 18 |
| 2 | — | 0 | $SO_2$ | — | 3 | NHCOO | 16 |
| 2 | — | 0 | $SO_2$ | p-phenylene | 0 | OCONH | 18 |
| 4 | — | 0 | $SO_2$ | — | 2 | CONHCO | 16 |
| 2 | — | 0 | $SO_2$ | — | 12 | NHCONHCO | 8 |
| 3 | — | 0 | $SO_2$ | — | 6 | CONHNHCO | 16 |
| 4 | — | 0 | $SO_2$ | — | 4 | CONHCONH | 14 |
| 5 | — | 0 | $SO_2$ | — | 10 | NHCONHNH | 10 |
| 2 | — | 0 | $SO_2$ | — | 2 | NHNHCONH | 18 |
| 3 | — | 0 | $SO_2$ | — | 6 | NHCOCONH | 20 |
| 4 | — | 0 | $SO_2$ | — | 6 | NHCONHNHCO | 18 |
| 2 | — | 0 | $SO_2$ | p-phenylene | 8 | CONHNHCOO | 18 |
| 2 | — | 0 | $SO_2$ | — | 4 | CONHNHCONH | 18 |
| 2 | — | 0 | S | — | 0 | — | 20 |
| 1 | — | 0 | S | — | 0 | — | 14 |
| 2 | — | 0 | S | — | 0 | — | 16 |
| 2 | — | 0 | | — | 0 | — | 18 |
| 3 | — | 0 | S | — | 0 | — | 22 |
| 3 | — | 0 | S | — | 4 | S | 12 |
| 2 | — | 0 | S | p-phenylene | 0 | S | 18 |
| 1 | — | 0 | S | — | 3 | $SO_2$ | 16 |
| 2 | — | 0 | S | — | 2 | CONH | 18 |
| 2 | — | 0 | S | p-phenylene | 0 | CONH | 18 |
| 3 | — | 0 | S | — | 3 | $SO_2NH$ | 16 |
| 2 | — | 0 | S | — | 1 | NHCO | 18 |
| 2 | — | 0 | S | — | 2 | $NHSO_2$ | 18 |
| 3 | — | 0 | S | — | 12 | NHCONH | 8 |
| 2 | — | 0 | S | p-phenylene | 0 | NHCONH | 15 |
| 2 | — | 0 | S | — | 3 | NHCOO | 16 |
| 2 | — | 0 | S | p-phenylene | 0 | OCONH | 18 |
| 4 | — | 0 | S | — | 2 | CONHCO | 16 |
| 2 | — | 0 | S | — | 4 | NHCONHNH | 18 |
| 3 | — | 0 | S | — | 6 | CONHNHCO | 16 |
| 4 | — | 0 | S | — | 4 | CONHCONH | 14 |
| 2 | — | 0 | S | — | 2 | NHNHCONH | 18 |
| 3 | — | 0 | S | — | 6 | NHCOCONH | 20 |
| 4 | — | 0 | S | — | 6 | NHCONHNHCO | 18 |
| 2 | — | 0 | S | — | 4 | CONHNHCONH | 18 |
| 2 | — | 0 | NHCO | — | 0 | — | 20 |
| 1 | — | 0 | NHCO | — | 0 | — | 12 |
| 2 | — | 0 | NHCO | — | 0 | — | 18 |
| 3 | — | 0 | NHCO | — | 0 | — | 22 |
| 4 | — | 0 | NHCO | — | 0 | — | 15 |
| 3 | — | 0 | NHCO | — | 4 | S | 12 |
| 2 | — | 0 | NHCO | p-phenylene | 0 | S | 18 |
| 1 | — | 0 | NHCO | — | 3 | $SO_2$ | 16 |
| 2 | — | 0 | NHCO | — | 2 | CONH | 18 |
| 3 | — | 0 | NHCO | — | 3 | $SO_2NH$ | 16 |
| 4 | — | 0 | NHCO | — | 3 | SCO | 16 |
| 4 | — | 0 | NHCO | — | 10 | NHCO | 14 |
| 4 | — | 0 | NHCO | — | 6 | N═CH | 16 |
| 2 | — | 0 | NHCO | — | 6 | NHCONH | 14 |
| 2 | — | 0 | NHCO | p-phenylene | 0 | NHCONH | 18 |
| 4 | — | 0 | NHCO | — | 4 | OCONH | 18 |
| 2 | — | 0 | NHCO | p-phenylene | 0 | OCONH | 18 |
| 3 | — | 0 | NHCO | — | 6 | NHCSO | 18 |
| 2 | — | 0 | NHCO | — | 12 | NHCONHCO | 8 |
| 3 | — | 0 | NHCO | — | 6 | CONHNHCO | 16 |
| 4 | — | 0 | NHCO | — | 4 | CONHCONH | 14 |
| 5 | — | 0 | NHCO | — | 10 | NHCONHNH | 10 |
| 3 | — | 0 | NHCO | — | 6 | NHCOCONH | 20 |
| 2 | — | 0 | NHCO | p-phenylene | 8 | CONHNHCOO | 18 |
| 1 | — | 0 | CONH | — | 0 | — | 12 |
| 2 | — | 0 | CONH | — | 0 | — | 16 |
| 2 | — | 0 | CONH | — | 0 | — | 18 |
| 3 | — | 0 | CONH | — | 0 | — | 22 |
| 5 | — | 0 | CONH | — | 0 | — | 11 |
| 2 | — | 0 | CONH | p-phenylene | 0 | S | 18 |
| 1 | — | 0 | CONH | — | 3 | SO | 16 |
| 2 | — | 0 | CONH | — | 2 | CONH | 18 |
| 2 | — | 0 | CONH | p-phenylene | 0 | CONH | 18 |
| 4 | — | 0 | CONH | — | 3 | SCO | 16 |
| 1 | — | 0 | CONH | — | 6 | OCO | 10 |
| 4 | — | 0 | CONH | — | 10 | NHCO | 14 |
| 2 | — | 0 | CONH | — | 4 | COO | 22 |
| 2 | — | 0 | CONH | — | 2 | $NHSO_2$ | 18 |

TABLE 2-continued

| p | A | q | X | B | r | Y | S |
|---|---|---|---|---|---|---|---|
| 3 | — | 0 | CONH | — | 12 | NHCONH | 8 |
| 2 | — | 0 | CONH | p-phenylene | 0 | NHCONH | 18 |
| 5 | — | 0 | CONH | — | 2 | NHSONH | 20 |
| 2 | — | 0 | CONH | — | 3 | NHCOO | 16 |
| 4 | — | 0 | CONH | — | 4 | OCONH | 18 |
| 2 | — | 0 | CONH | p-phenylene | 0 | OCONH | 18 |
| 3 | — | 0 | CONH | — | 6 | NHCSO | 18 |
| 4 | — | 0 | CONH | — | 2 | CONHCO | 16 |
| 2 | — | 0 | CONH | — | 12 | NHCONHCO | 8 |
| 3 | — | 0 | CONH | — | 6 | CONHNHCO | 16 |
| 4 | — | 0 | CONH | — | 4 | CONHCONH | 14 |
| 2 | — | 0 | CONH | — | 2 | NHNHCONH | 18 |
| 3 | — | 0 | CONH | — | 6 | NHCOCONH | 20 |
| 4 | — | 0 | CONH | — | 6 | NHCONHNHCO | 18 |
| 2 | — | 0 | CONH | p-phenylene | 8 | CONHNHCOO | 18 |
| 2 | — | 0 | NHCONH | — | 0 | — | 20 |
| 2 | — | 0 | NHCONH | — | 0 | — | 16 |
| 2 | — | 0 | NHCONH | — | 0 | — | 18 |
| 3 | — | 0 | NHCONH | — | 0 | — | 22 |
| 4 | — | 0 | NHCONH | — | 0 | — | 18 |
| 3 | — | 0 | NHCONH | — | 4 | S | 12 |
| 2 | — | 0 | NHCONH | p-phenylene | 0 | S | 18 |
| 1 | — | 0 | NHCONH | — | 3 | $SO_2$ | 16 |
| 4 | — | 0 | NHCONH | — | 10 | CONH | 6 |
| 2 | — | 0 | NHCONH | p-phenylene | 0 | CONH | 18 |
| 3 | — | 0 | NHCONH | — | 3 | $SO_2NH$ | 16 |
| 4 | — | 0 | NHCONH | — | 3 | SCO | 16 |
| 4 | — | 0 | NHCONH | — | 10 | NHCO | 14 |
| 3 | — | 0 | NHCONH | — | 12 | COS | 6 |
| 2 | — | 0 | NHCONH | — | 4 | COO | 22 |
| 2 | — | 0 | NHCONH | — | 6 | NHCONH | 14 |
| 2 | — | 0 | NHCONH | p-phenylene | 0 | NHCONH | 18 |
| 5 | — | 0 | NHCONH | — | 2 | NHSONH | 20 |
| 2 | — | 0 | NHCONH | — | 3 | NHCOO | 16 |
| 2 | — | 0 | NHCONH | p-phenylene | 0 | OCONH | 18 |
| 1 | — | 0 | NHCONH | — | 3 | NHCOO | 14 |
| 3 | — | 0 | NHCONH | — | 6 | NHCSO | 18 |
| 2 | — | 0 | NHCONH | — | 12 | NHCONHCO | |
| 2 | — | 0 | NHCONH | — | 4 | NHCONHNH | 18 |
| 3 | — | 0 | NHCONH | — | 6 | CONHNHCO | 16 |
| 4 | — | 0 | NHCONH | — | 4 | CONHCONH | 14 |
| 5 | — | 0 | NHCONH | — | 10 | NHCONHNH | 10 |
| 2 | — | 0 | NHCONH | — | 2 | NHNHCONH | 18 |
| 3 | — | 0 | NHCONH | — | 6 | NHCOCONH | 20 |
| 2 | — | 0 | NHCONH | — | 4 | CONHNHCONH | 18 |
| 1 | p-phenylene | 0 | NHCONH | — | 0 | — | 18 |
| 1 | p-phenylene | 0 | NHCONH | — | 0 | — | 22 |
| 2 | p-phenylene | 0 | NHCONH | — | 0 | — | 16 |
| 3 | p-phenylene | 0 | NHCONH | — | 0 | — | 18 |
| 1 | p-phenylene | 1 | NHCONH | — | 0 | — | 18 |
| 1 | p-phenylene | 2 | NHCONH | — | 0 | — | 16 |
| 2 | p-phenylene | 1 | NHCONH | — | 0 | — | 20 |
| 1 | p-phenylene | 0 | NHCONH | — | 6 | O | 16 |
| 1 | p-phenylene | 1 | NHCONH | — | 2 | O | 18 |
| 2 | p-phenylene | 0 | NHCONH | — | 0 | O | 14 |
| 2 | p-phenylene | 0 | NHCONH | p-phenylene | 0 | O | 18 |
| 1 | p-phenylene | 0 | NHCONH | p-phenylene | 0 | OCO | 20 |
| 1 | p-phenylene | 2 | NHCONH | p-phenylene | 0 | CO | 18 |
| 1 | p-phenylene | 0 | NHCONH | p-phenylene | 0 | S | 22 |
| 2 | p-phenylene | 0 | NHCONH | p-phenylene | 0 | NHCO | 16 |
| 1 | p-phenylene | 0 | NHCONH | p-phenylene | 0 | CONH | 18 |
| 1 | p-phenylene | 1 | NHCONH | p-phenylene | 0 | NHCONH | 18 |
| 1 | p-phenylene | 0 | NHCONH | p-phenylene | 0 | COO | 20 |
| 2 | p-phenylene | 0 | NHCONH | p-phenylene | 0 | $SO_2$ | 14 |
| 1 | p-phenylene | 0 | NHCO | — | 0 | — | 18 |
| 1 | p-phenylene | 0 | NHCO | — | 0 | — | 22 |
| 2 | p-phenylene | 0 | NHCO | — | 0 | — | 16 |
| 3 | p-phenylene | 0 | NHCO | — | 0 | — | 18 |
| 1 | p-phenylene | 1 | NHCO | — | 0 | — | 18 |
| 1 | p-phenylene | 2 | NHCO | — | 0 | — | 16 |
| 2 | p-phenylene | 1 | NHCO | — | 0 | — | 20 |
| 1 | p-phenylene | 0 | NHCO | — | 6 | O | 16 |
| 1 | p-phenylene | 1 | NHCO | — | 2 | O | 18 |
| 2 | p-phenylene | 0 | NHCO | — | 8 | O | 14 |
| 2 | p-phenylene | 0 | NHCO | p-phenylene | 0 | O | 18 |
| 1 | p-phenylene | 0 | NHCO | p-phenylene | 0 | OCO | 20 |
| 1 | p-phenylene | 2 | NHCO | p-phenylene | 0 | CO | 18 |

TABLE 2-continued

| p | A | q | X | B | r | Y | S |
|---|---|---|---|---|---|---|---|
| 1 | p-phenylene | 0 | NHCO | p-phenylene | 0 | S | 22 |
| 2 | p-phenylene | 0 | NHCO | p-phenylene | 0 | NHCO | 16 |
| 1 | p-phenylene | 0 | NHCO | p-phenylene | 0 | CONH | 18 |
| 1 | p-phenylene | 1 | NHCO | p-phenylene | 0 | NHCONH | 18 |
| 1 | p-phenylene | 0 | NHCO | p-phenylene | 0 | CO | 20 |
| 2 | p-phenylene | 0 | NHCO | p-phenylene | 0 | $SO_2$ | 14 |
| 1 | p-phenylene | 0 | CONH | — | 0 | — | 18 |
| 1 | p-phenylene | 0 | CONH | — | 0 | — | 22 |
| 2 | p-phenylene | 0 | CONH | — | 0 | — | 16 |
| 3 | p-phenylene | 0 | CONH | — | 0 | — | 18 |
| 1 | p-phenylene | 1 | CONH | — | 0 | — | 18 |
| 1 | p-phenylene | 2 | CONH | — | 0 | — | 16 |
| 2 | p-phenylene | 1 | CONH | — | 0 | — | 20 |
| 1 | p-phenylene | 0 | CONH | — | 6 | O | 16 |
| 1 | p-phenylene | 1 | CONH | — | 2 | O | 18 |
| 2 | p-phenylene | 0 | CONH | — | 8 | O | 14 |
| 2 | p-phenylene | 0 | CONH | p-phenylene | 0 | O | 18 |
| 1 | p-phenylene | 0 | CONH | p-phenylene | 0 | OCO | 20 |
| 1 | p-phenylene | 2 | CONH | p-phenylene | 0 | CO | 18 |
| 1 | p-phenylene | 0 | CONH | p-phenylene | 0 | S | 22 |
| 2 | p-phenylene | 0 | CONH | p-phenylene | 0 | NHCO | 16 |
| 1 | p-phenylene | 0 | CONH | p-phenylene | 0 | CONH | 18 |
| 1 | p-phenylene | 1 | CONH | p-phenylene | 0 | NHCONH | 18 |
| 1 | p-phenylene | 0 | CONH | p-phenylene | 0 | COO | 20 |
| 2 | p-phenylene | 0 | CONH | p-phenylene | 0 | $SO_2$ | 14 |
| 1 | p-phenylene | 0 | OCONH | — | 0 | — | 18 |
| 2 | p-phenylene | 0 | OCONH | — | 0 | — | 16 |
| 3 | p-phenylene | 0 | OCONH | — | 0 | — | 18 |
| 1 | p-phenylene | 1 | OCONH | — | 0 | — | 18 |
| 1 | p-phenylene | 2 | OCONH | — | 0 | — | 16 |
| 2 | p-phenylene | 1 | OCONH | — | 0 | — | 20 |

Carboxylic acid compounds useful as a coloring developer also include the compounds having the following formula (7):

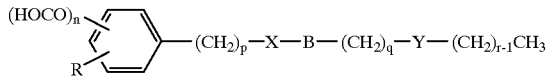

(7)

wherein p, q, r, X, B and Y are defined in formula (6), R represents a hydrogen atom or a monovalent group and n is an integer of from 1 to 3.

Specific examples of such compounds having the formula (7) include compounds shown in Table 3 in which each number or structure of the characters, n, p, q, r, R. B, X and Y, of the compounds is described.

TABLE 3

| n | R | p | X | B | q | Y | r |
|---|---|---|---|---|---|---|---|
| 1(4-) | — | 0 | NHCONH | — | 0 | — | 18 |
| 1(4-) | — | 1 | NHCONH | — | 0 | — | 20 |
| 2(3-,5-) | — | 0 | NHCONH | — | 0 | — | 14 |
| 2(4-) | (3-OH) | 0 | NHCONH | — | 0 | — | 18 |
| 1(4-) | (2-$CH_3$) | 0 | NHCONH | — | 0 | — | 16 |
| 1(4-) | (3-Cl) | 2 | NHCONH | — | 0 | — | 18 |
| 1(3-) | (4-OH) | 0 | NHCONH | — | 0 | — | 22 |
| 1(4-) | (3-OH) | 0 | NHCONH | — | 6 | O | 14 |
| 1(4-) | (3-OH) | 1 | NHCONH | p-phenylene | 0 | O | 18 |
| 1(4-) | (3-Cl) | 0 | NHCONH | p-phenylene | 0 | S | 16 |
| 1(3-) | (4-OH) | 0 | NHCONH | p-phenylene | 0 | NHCO | 18 |
| 1(3-) | (4-OH) | 0 | NHCONH | p-phenylene | 0 | CONH | 20 |
| 1(4-) | (3-OH) | 0 | NHCONH | p-phenylene | 0 | NHCONH | 18 |
| 1(4-) | (3-$OCH_3$) | 1 | NHCONH | p-phenylene | 0 | OCO | 14 |
| 1(4-) | (3-OH) | 0 | NHCONH | p-phenylene | 0 | COO | 18 |
| 1(4-) | (3-Cl) | 0 | NHCONH | p-phenylene | 0 | $SO_2$ | 18 |

TABLE 3-continued

| n | R | p | X | B | q | Y | r |
|---|---|---|---|---|---|---|---|
| 1(4-) | (3-OH) | 0 | NHCONH | p-phenylene | 0 | $SO_2NH$ | 18 |
| 1(4-) | — | 0 | NHCO | — | 0 | — | 18 |
| 1(4-) | — | 2 | NHCO | — | 0 | — | 20 |
| 2(3-,4-) | — | 0 | NHCO | — | 0 | — | 14 |
| 2(4-) | (3-OH) | 0 | NHCO | — | 0 | — | 18 |
| 1(4-) | (2-$CH_3$) | 0 | NHCO | — | 0 | — | 16 |
| 1(4-) | (3-Cl) | 2 | NHCO | — | 0 | — | 18 |
| 1(3-) | (4-OH) | 0 | NHCO | — | 0 | — | 22 |
| 1(4-) | (3-OH) | 0 | NHCO | — | 6 | O | 14 |
| 1(4-) | (3-OH) | 1 | NHCO | p-phenylene | 0 | O | 18 |
| 1(4-) | (3-Cl) | 0 | NHCO | p-phenylene | 0 | CO | 16 |
| 1(3-) | (4-OH) | 0 | NHCO | p-phenylene | 0 | NHCO | 18 |
| 1(3-) | (4-OH) | 0 | NHCO | p-phenylene | 0 | CONH | 20 |
| 1(4-) | (3-OH) | 0 | NHCO | p-phenylene | 0 | NHCONH | 18 |
| 1(4-) | (3-$OCH_3$) | 1 | NHCO | p-phenylene | 0 | OCO | 14 |
| 1(4-) | (3-OH) | 0 | NHCO | p-phenylene | 0 | COO | 18 |
| 1(4-) | (3-Cl) | 0 | NHCO | p-phenylene | 0 | $SO_2$ | 18 |
| 1(4-) | (3-OH) | 0 | NHCO | p-phenylene | 0 | $SO_2NH$ | 18 |
| 1(4-) | — | 0 | CONH | — | 0 | — | 18 |
| 1(4-) | — | 1 | CONH | — | 0 | — | 20 |
| 2(3-,5-) | — | 0 | CONH | — | 0 | — | 14 |
| 2(4-) | (3-OH) | 0 | CONH | — | 0 | — | 18 |
| 1(4-) | (2-$CH_3$) | 0 | CONH | — | 0 | — | 16 |
| 1(4-) | (3-Cl) | 2 | CONH | — | 0 | — | 18 |
| 1(3-) | (4-OH) | 0 | CONH | — | 0 | — | 22 |
| 1(4-) | (3-OH) | 0 | CONH | — | 6 | O | 14 |
| 1(4-) | (3-OH) | 1 | CONH | p-phenylene | 0 | O | 18 |
| 1(4-) | (3-Cl) | 0 | CONH | p-phenylene | 0 | S | 16 |
| 1(3-) | (4-OH) | 0 | CONH | p-phenylene | 0 | NHCO | 18 |
| 1(3-) | (4-OH) | 0 | CONH | p-phenylene | 0 | CONH | 20 |
| 1(4-) | (3-OH) | 0 | CONH | p-phenylene | 0 | NHCONH | 18 |
| 1(4-) | (3-$OCH_3$) | 1 | CONH | p-phenylene | 0 | OCO | 14 |
| 1(4-) | (3-OH) | 0 | CONH | p-phenylene | 0 | COO | 18 |
| 1(4-) | (3-Cl) | 0 | CONH | p-phenylene | 0 | $SO_2$ | 18 |
| 1(4-) | (3-OH) | 0 | CONH | p-phenylene | 0 | $SO_2NH$ | 18 |
| 1(4-) | — | 0 | OCONH | — | 0 | — | 18 |
| 1(4-) | — | 2 | NHCOO | — | 0 | — | 20 |

TABLE 3-continued

| n | R | p | X | B | q | Y | r |
|---|---|---|---|---|---|---|---|
| 2(3-,5-) | — | 0 | OCONH | — | 0 | — | 14 |
| 2(4-) | (3-OH) | 0 | NHCOO | — | 0 | — | 18 |
| 1(4-) | (2-$CH_3$) | 0 | OCONH | — | 0 | — | 16 |
| 1(4-) | (3-Cl) | 2 | NHCOO | — | 0 | — | 18 |
| 1(3-) | (4-OH) | 0 | OCONH | — | 0 | — | 22 |
| 1(4-) | (3-OH) | 0 | NHCOO | — | 6 | O | 14 |
| 1(4-) | (3-OH) | 1 | OCONH | p-phenylene | 0 | O | 18 |
| 1(4-) | (3-Cl) | 0 | NHCOO | p-phenylene | 0 | CO | 16 |
| 1(3-) | (4-OH) | 0 | OCONH | p-phenylene | 0 | NHCO | 18 |
| 1(3-) | (4-OH) | 0 | NHCOO | p-phenylene | 0 | CONH | 20 |
| 1(4-) | (3-OH) | 0 | OCONH | p-phenylene | 0 | NHCONH | 18 |
| 1(4-) | (3-$OCH_3$) | 1 | NHCOO | p-phenylene | 0 | OCO | 14 |
| 1(4-) | (3-OH) | 0 | OCONH | p-phenylene | 0 | COO | 18 |
| 1(4-) | (3-Cl) | 0 | NHCOO | p-phenylene | 0 | $SO_2$ | 18 |
| 1(4-) | (3-OH) | 0 | OCONH | p-phenylene | 0 | $SO_2NH$ | 18 |
| 1(4-) | — | 0 | OCO | — | 0 | — | 18 |
| 1(4-) | — | 1 | COO | — | 0 | — | 20 |
| 2(3-,5-) | — | 0 | OCO | — | 0 | — | 14 |
| 2(4-) | (3-OH) | 0 | COO | — | 0 | — | 18 |
| 1(4-) | (2-$CH_3$) | 0 | OCO | — | 0 | — | 16 |
| 1(4-) | (3-Cl) | 2 | COO | — | 0 | — | 18 |
| 1(3-) | (4-OH) | 0 | OCO | — | 0 | — | 22 |
| 1(4-) | (3-OH) | 0 | COO | — | 6 | O | 14 |
| 1(4-) | (3-OH) | 1 | OCO | p-phenylene | 0 | O | 18 |
| 1(4-) | (3-Cl) | 0 | COO | p-phenylene | 0 | S | 16 |
| 1(3-) | (4-OH) | 0 | OCO | p-phenylene | 0 | NHCO | 18 |
| 1(3-) | (4-OH) | 0 | COO | p-phenylene | 0 | CONH | 20 |
| 1(4-) | (3-OH) | 0 | OCO | p-phenylene | 0 | NHCONH | 18 |
| 1(4-) | (3-$OCH_3$) | 1 | COO | p-phenylene | 0 | OCO | 14 |
| 1(4-) | (3-OH) | 0 | OCO | p-phenylene | 0 | COO | 18 |
| 1(4-) | (3-Cl) | 0 | COO | p-phenylene | 0 | $SO_2$ | 18 |
| 1(4-) | (3-OH) | 0 | OCO | p-phenylene | 0 | $SO_2NH$ | 18 |
| 1(4-) | — | 0 | O | — | 0 | — | 18 |
| 1(4-) | — | 2 | S | — | 0 | — | 20 |
| 2(3-,4-) | — | 0 | O | — | 0 | — | 14 |
| 2(4-) | (3-OH) | 0 | S | — | 0 | — | 18 |
| 1(4-) | (2-$CH_3$) | 0 | O | — | 0 | — | 16 |
| 1(4-) | (3-Cl) | 2 | S | — | 0 | — | 18 |
| 1(3-) | (4-OH) | 0 | O | — | 0 | — | 22 |
| 1(4-) | (3-OH) | 0 | S | — | 6 | O | 14 |
| 1(4-) | (3-OH) | 1 | O | p-phenylene | 0 | O | 18 |
| 1(4-) | (3-Cl) | 0 | S | p-phenylene | 0 | CO | 16 |
| 1(3-) | (4-OH) | 0 | O | p-phenylene | 0 | NHCO | 18 |
| 1(3-) | (4-OH) | 0 | S | p-phenylene | 0 | CONH | 20 |
| 1(4-) | (3-OH) | 0 | O | p-phenylene | 0 | NHCONH | 18 |
| 1(4-) | (3-$OCH_3$) | 1 | S | p-phenylene | 0 | OCO | 14 |
| 1(4-) | (3-OH) | 0 | O | p-phenylene | 0 | COO | 18 |
| 1(4-) | (3-Cl) | 0 | S | p-phenylene | 0 | $SO_2$ | 18 |
| 1(4-) | (3-OH) | 0 | O | p-phenylene | 0 | $SO_2NH$ | 18 |
| 1(4-) | — | 0 | $SO_2$ | — | 0 | — | 18 |
| 1(4-) | — | 1 | $SO_2NH$ | — | 0 | — | 20 |
| 2(3-,5-) | — | 0 | $SO_2$ | — | 0 | — | 14 |
| 2(4-) | (3-OH) | 0 | $SO_2NH$ | — | 0 | — | 18 |
| 1(4-) | (2-$CH_3$) | 0 | $SO_2$ | — | 0 | — | 16 |
| 1(4-) | (3-Cl) | 2 | $SO_2NH$ | — | 0 | — | 18 |
| 1(3-) | (4-OH) | 0 | $SO_2$ | — | 0 | — | 22 |
| 1(4-) | (3-OH) | 0 | $SO_2NH$ | — | 6 | O | 14 |
| 1(4-) | (3-OH) | 1 | $SO_2$ | p-phenylene | 0 | O | 18 |
| 1(4-) | (3-Cl) | 0 | $SO_2NH$ | p-phenylene | 0 | S | 16 |
| 1(3-) | (4-OH) | 0 | $SO_2$ | p-phenylene | 0 | NHCO | 18 |
| 1(3-) | (4-OH) | 0 | $SO_2NH$ | p-phenylene | 0 | CONH | 20 |
| 1(4-) | (3-OH) | 0 | $SO_2$ | p-phenylene | 0 | NHCONH | 18 |
| 1(4-) | (3-$OCH_3$) | 1 | $SO_2NH$ | p-phenylene | 0 | OCO | 14 |
| 1(4-) | (3-OH) | 0 | $SO_2$ | p-phenylene | 0 | COO | 18 |
| 1(4-) | (3-Cl) | 0 | $SO_2NH$ | p-phenylene | 0 | $SO_2$ | 18 |
| 1(4-) | (3-OH) | 0 | $SO_2$ | p-phenylene | 0 | $SO_2NH$ | 18 |

The mixing ratio of the coloring agent and the coloring developer in the recording layer, which depends on the materials of the coloring agent and the coloring developer used, is from about 1/0.1 to about 1/20 by mole, and preferably from about 1/0.2 to about 1/10, to maintain good image density of the recorded image.

The recording layer of the recording material of the present invention includes a coloring agent and a coloring developer in a resin which is crosslinked with an isocyanate compound. Preferably; the coloring agent and the coloring developer are finely and uniformly dispersed in the crosslinked resin. More preferably, the coloring agent and the coloring developer are dispersed while they form complex particles. These complex particles can be obtained by melting (or dissolving in a solvent) a coloring agent and a coloring developer and then cooling the mixture of the coloring agent and the coloring developer (or drying the solvent). The recording layer including the complex particles can be obtained by coating on a substrate a recording layer coating liquid in which each of a coloring agent and a coloring developer is dispersed or dissolved in a respective solvent and then mixed, or both of them are dispersed or dissolved in a solvent, and then drying the coated liquid. The coloring agent and the coloring developer may be used while being microencapsulated. The recording layer can be crosslinked by a heat crosslinking method, an ultraviolet light crosslinking method or an electron beam crosslinking method. Crosslinking conditions depend on the material of the crosslinkable resin used in the recording layer. For example, the recording layer can be crosslinked upon application of high temperature heat for a short time or can be crosslinked upon application of low temperature heat for a long time. The recording layer can also be crosslinked by the ultraviolet light crosslinking method or the electron beam crosslinking method which is described later in the protective layer.

The weight ratio of the total of the coloring agent and the coloring developer to the resin in the recording layer is preferably from about 1/0.1 to about 1/10 to maintain good heat resistance of the recording layer and good image density of the recorded image.

Suitable solvents for use in the recording layer coating liquid preferably include solvents which do not have a hydroxy group, an amino group, a carboxyl group or the like to avoid a reaction of the solvent with the isocyanate compound. Specific examples of such solvents include tetrahydrofuran, methyl ethyl ketone, toluene, xylene, ethyl acetate, butyl acetate or the like which are employed alone or in combination. A small amount of water and alcohols can be employed in the recording layer coating liquid.

The recording layer of the recording material of the present invention may include an image formation and/or an image erasure controlling agent. A compound having a basic image erasing group such as secondary amines, tertiary amines and the like, and an image erasure promoting compound having a relatively low melting point and ability to promote image erasure can be employed.

Image formation controlling agents which can maintain a recorded image stable include long chain alkyl compounds which have a similar structure as the coloring developers to stably maintain the cohered structure of the recorded image in which the coloring agent and the coloring developer are regularly cohered. In addition, the image formation controlling agent preferably has a group having an associating ability to maintain the cohered structure more stable. These image formation controlling agents can destroy the cohered structure when the controlling agents melt at their melting points. Namely, these image formation controlling agents also have an image erasure function. This type of image formation/erasure controlling agent is preferable because of not obstructing the image formation and not decreasing the image density when the recording material is repeatedly used. Therefore, by including the image formation/erasure controlling agent in the recording layer, the recorded image can be stably maintained and also can be easily erased. The melting point of the image formation/erasure controlling agent is preferably from 60 to 130° C., and more preferably from 75 to 120° C.

The content of the image formation/erasure controlling agent in the recording layer is preferably from 0.1 to 300 parts by weight, and more preferably from 3 to 100 parts by weight, per 100 parts by weight of the coloring developer included in the recording layer.

Suitable image formation/erasure controlling agents include compounds having the following formula (8) or (9), but are not limited thereto:

$$R1-(X2-R2)_n X1 \quad (8)$$

$$R1-(X2-R2)_n X3-(R2'-X2')_m R1' \quad (9)$$

wherein R1 and R1' independently represent a monovalent alkyl group such as a linear aliphatic alkyl group, a branched aliphatic alkyl group, an aromatic group or an aromatic group having an aliphatic alkyl group therein, and the monovalent alkyl group may have a substituent, and X1 represents a monovalent group having a heteroatom; R2 and R2' independently represent a divalent alkyl group such as a linear aliphatic alkyl group, a branched aliphatic alkyl group, an aromatic group or an aromatic group having an aliphatic alkyl group therein, and the divalent alkyl group may have a substituent; X2, X3 and X2' independently represent a divalent group having a heteroatom; n is 0, 1, 2, 3 or 4; m is 0, 1, 2, 3 or 4, and when n and m are 2 or more, each of the characters, R2, R2', X2 and X2', which are repeated, may be the same or different from each of the characters, R2, R2', X2 and X2', in another repeating unit. The carbon number of R1, R1', R2 and R2' is preferably from 1 to 22, and the total carbon number of the linear aliphatic alkyl groups in the main chain of each image formation/erasure controlling agent is preferably 8 or more.

Specific examples of the image formation/erasure controlling agents are as follows:

$CH_3(CH_2)_p—CONH_2$,
$CH_3(CH_2)_p—NHCONH_2$,
$CH_3(CH_2)_p—CONHNH_2$,
$CH_3(CH_2)_p—NHCONH—(CH_2)_p'—CONHNH_2$,
$CH_3(CH_2)_p—NHCONH—(CH_2)_p'—CONH—(CH_2)_p''—CONHNH_2$,
$CH_3(CH_2)_p—CONH—(CH_2)_p'CH_3$,
$CH_3(CH_2)_p—NHCONH—(CH_2)_p'CH_3$,
$CH_3(CH_2)_p—CONHCO—(CH_2)_p'CH_3$,
$CH_3(CH_2)_p—CONHNHCO—(CH_2)_p'CH_3$,
$CH_3(CH_2)_p—NHCOCONH—(CH_2)_p'CH_3$,
$CH_3(CH_2)_p—NHCONH—(CH_2)_p'—NHCONH—(CH_2)_p''CH_3$,
$CH_3(CH_2)_p—NHCONH—(CH_2)_p'—CONH—(CH_2)_p''CH_3$,
$CH_3(CH_2)_p—CONHCO—(CH_2)_p'—NHCO—(CH_2)_p''CH_3$,
$CH_3(CH_2)_p—CONHNHCO—(CH_2)_p'—NHCO—(CH_2)_p''CH_3$,
$CH_3(CH_2)_p—NHCOCONH—(CH_2)_p'—NHCONH—(CH_2)_p''CH_3$,
$CH_3(CH_2)_p—NHCONH—(CH_2)_p'—O—(CH_2)_p''CH_3$,
$CH_3(CH_2)_p—NHCONH—(CH_2)_p'—S—(CH_2)_p''CH_3$,
$CH_3(CH_2)_p—NHCONH—(CH_2)_p'—COO—(CH_2)_p''CH_3$,
$CH_3(CH_2)_p—NHCO—(CH_2)_p'—NHCO—(CH2)_p''—NHCONH—(CH_2)_qCH_3$, and
$CH_3(CH_2)_p—CO—(CH_2)_p'—NHCO—(CH_2)_p''—NHCONH—(CH_2)_qCH_3$, wherein p and p' are independently 0 or an integer of from 1 to 21, and p" and q are independently an integer of from 1 to 22. As mentioned above, the total carbon number of the main chain of each compound is preferably 8 or more.

The recording layer of the recording material of the present invention may include an ultraviolet absorbing agent.

Specific examples of such an ultraviolet absorbing agent include:

inorganic ultraviolet absorbing agents zinc sulfide, titanium oxide, cerium oxide, tin oxide, molybdenumoxide, zinc oxide, galliumnitride, silica, alumina, antimony oxide, magnesium oxide, zirconium oxide, barium oxide, calcium oxide, strontium oxide, silicon nitride, aluminum nitride, boron nitride, barium sulfate or the like; and organic ultraviolet absorbing agents benzotriazole compounds such as, 2-(2'-hydroxy-5'-methylphenyl)benzotriazole, 2-(2'-hydroxy-5'-t-butylphenyl)benzotriazole, 2-(2'-hydroxy-3', 5'-di-t-butylphenyl)benzotriazole, 2-(2'-hydroxy-3'-t-butyl-5'-methylphenyl)benzotriazole, 2-(2'-hydroxy-5'-octoxyphenyl)benzotriazole, 2-(2'-hydroxy-3', 5'-di-t-butylphenyl)-5-chlorobenzotriazole and 2-(2'-hydroxy-3'-t-butyl-5'-ethoxyphenyl)benzotriazole; benzophenone compounds such as, 2, 4-dihydroxybenzophenone, 2-hydroxy-4-methoxybenzophenone, 2-hydroxy-4-n-octoxybenzophenone, 2-hydroxy-4-dodecyloxybenzophenone, 2, 2'-dihydroxy-4, 4'-dimethoxybenzophenone, 2, 2', 4, 4'-tetrahydroxybenzophenone, 2-hydroxy-4-methoxy-2'-carboxybenzophenone, 2-hydroxy-4-oxybenzylbenzophenone, 2-hydroxy-4-chlorobenzophenone, 2-hydroxy-4-methoxybenzophenone-5-sulfonic acid, 2-hydroxy-4-methoxybenzophenone-5-sulfonic acid sodium salt and 2, 2-dihydroxy-4, 4'-dimethoxybenzophenone-5-sulfonic acid sodium salt; salicylic acid ester compounds such as, phenyl salicylate, p-octylphenyl salicylate, p-t-butyl salicylate, carboxyphenyl salicylate, methylphenyl salicylate, dodecylphenyl salicylate, 2-ethylhexylphenyl salicylate and homomenthylphenyl salicylate; cyanoacrylate compounds such as, 2-ethylhexyl-2-cyano-3, 3'-diphenyl acrylate and ethyl-2-cyano-3, 3'-diphenyl acrylate; p-aminobenzoic acid compounds such as, p-aminobenzoic acid, glyceryl p-aminobenzoate, amyl p-dimethylaminobenzoate, and ethyl p-dihydroxypropylbenzoate; cinnamic acid compounds such as, 2-ethylhexyl p-methoxycinnamate and 2-ethoxyhexyl p-methoxycinnamate; urocanic acid compounds such as, urocanic acid and ethyl urocanate; and 4-t-butyl-4'-methoxy-dibenzoyl methane.

The recording layer may include a filler. To include a filler in the recording layer improves the feeding properties and the wearing resistance of the recording material when a thermal printhead is used as a heating device, and further prevents the recording material from sticking to a thermal printhead which causes an occurrence of undesired images such as white lines and absence of images.

Specific examples of such a filler include organic fillers such as polyolefin resin particles, polystyrene resin particles, urea-formaldehyde resin particles and hollow resin particles and inorganic fillers such as aluminum hydroxide, calcium carbonate (heavy or light), zinc oxide, titanium oxide, barium sulfate, silica, colloidal silica (10–50 μm), alumina (10–200 μm), activated clay, talc, clay, kaolinite, sintered kaolinite, diatom earth, synthesized kaolinite, zirconium compounds and glass hollow particles.

In addition, the recording layer may include an electroconductive agent to improve feeding properties of the recording material by preventing the recording material from charging caused by rubbing with a thermal printhead.

Suitable electroconductive agents include cationic polymers which are made by polymerizing monomers including an olefin monomer having a quarternary ammonium group which has following formula:

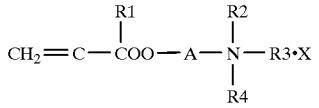

wherein R1 represents a hydrogen atom or a methyl group; A represents an alkylene group having carbon atoms of from 1 to 4 or a hydroxy alkylene group having carbon atoms of from 1 to 4; R2 and R3 independently represent an alkyl group having carbon atoms of from 1 to 4 or a hydroxy alkyl group having carbon atoms of from 2 to 4; R4 represents an alkyl group having carbon atoms of from 1 to 4, a hydroxy alkyl group having carbon atoms of from 2 to 4 or an aralkyl group having carbon atoms of from 2 to 4; and X represents a counter ion such as a halogen ion, $CH_3OSO_3^-$, $C_2H_5OSO_3^-$, $HSO_4^-$, $H_2PO_4^-$, $CH_3COO^-$, $CH_3SO_3^-$ or $NO_2^-$, and preferably X is one of $Cl^-$, $Br^-$, $CH_3OSO_3^-$, $C_2H_5OSO_3^-$ and $HSO_4^-$.

Suitable monomers useful for polymerizing a cationic polymer also include vinyl benzyl trialkyl ammonium salts (vinyl benzyl trimethyl ammonium chloride and the like), dialkyl diallyl vinyl monomers such as dialkyl diallyl ammonium salts (dimethyl diallyl ammonium chloride and the like) and vinyl monomers having a quaternary ammonium group such as quaternary ammonium salts of vinyl imidazoline and vinyl pyridine.

Suitable monomers which are used for copolymerizing with the above-mentioned monomers include vinyl monomers such as unsaturated alkyl esters such as alkyl acrylate, alkyl methacrylate, alkyl crotonate, mono-(or di-)alkyl methaconate; unsaturated aromatic monomers such as styrene, methylstyrene and chlorostyrene; unsaturated nitrile compounds such as acrylonitrile and methacrylonitrile; olefins or halo-olefins such as ethylene, vinyl chloride and vinylidene chloride; vinyl esters such as vinyl acetate; unsaturated acids such as acrylic acid, methacrylic acid and crotonic acid; and monomers having a functional group such as unsaturated acid amides, N-methylol unsaturated acid amides, glycidyl (meth)acrylate and hydroxyalkyl (meth) acrylate.

The recording layer may include auxiliary agents such as dispersants, surfactants, lubricants, antioxidants and photostabilizers.

The recording layer may include a thermoplastic resin together with the crosslinked resin. Specific examples of such a thermoplastic resin include polyvinyl chloride resins, polyvinyl acetate resins, vinyl chloride-vinyl acetate copolymers, polystyrene resins, styrene copolymers, phenoxy resins, polyester resins, aromatic polyester resins, polyurethane resins, polycarbonate resins, polyacrylate resins, polymethacrylate resins, acrylic copolymers and maleic anhydride copolymers.

The recording layer may be formed on one side or both sides of a substrate.

The recording material of the present invention may include a protective layer including a crosslinked resin on the recording layer. The crosslinked resin in the protective layer includes a crosslinked resin which is crosslinked upon application of heat, ultraviolet light, electron beam, or the like. By using such a crosslinked resin in the protective layer, the recording material has good ability to be used with thermal printhead and good durability even when the recording material is used repeatedly.

A crosslinked resin is obtained by heating a mixture of a crosslinking agent and a crosslinkable resin having an active group which can react with the crosslinking agent upon application of heat.

Specific examples of such a heat-crosslinkable resin include resins having an active group such as a hydroxy group, a carboxy group and the like, e.g., phenoxy resins, polyvinyl butyral resins, cellulose acetate propionate and cellulose acetate butyrate. In addition, a copolymer of a monomer having an active group such as a hydroxy group, a carboxyl group or the like and a monomer such as vinyl chloride, an acrylic monomer, styrene or the like can be employed. Specific examples of such a copolymer include vinyl chloride-vinyl acetate-vinyl alcohol copolymers, vinyl chloride-vinyl acetate-hydroxypropyl acrylate copolymers, vinyl chloride-vinyl acetate-maleic anhydride copolymers and the like.

Suitable crosslinking agents which can crosslink these resins upon application of heat include isocyanate compounds, amino resins, phenol resins, amines, epoxy compounds and the like. For example, specific examples of such isocyanate compounds include poly isocyanate compounds having a plurality of isocyanate groups such as hexamethylene diisocyanate (HDI), tolylene diisocyanate (TDI), xylylene diisocyanate (XDI), adducts thereof with trimethylol propane and the like, buret type compounds thereof, isocyanurate type compounds thereof and blocked isocyanate compounds thereof.

As for the addition quantity of the crosslinking agents, the ratio of the number of the active group included in the resin to the number of the functional group included in the crosslinking agent in the protective layer is preferably from about 0.01 to about 1 to maintain good heat resistance and good image formation/erasure properties of the recording material.

In addition, the protective layer may include a crosslinking promoter, which is a catalyst useful for this kind of reaction, for example, tertiary amines such as 1, 4-diazabicyclo(2, 2, 2) octane, and metal compounds such as organic tin compounds.

Suitable monomers useful for forming the protective layer which can be crosslinked upon application of electron beam or ultraviolet light include, but are not limited to:

monomers having one functional group methyl methacrylate, ethyl methacrylate, n-butyl methacrylate, iso-butyl methacrylate, t-butyl methacrylate, 2-ethylhexyl methacrylate, lauryl methacrylate, tridecyl methacrylate, stearyl methacrylate, cyclohexyl methacrylate, benzyl methacrylate, methacrylic acid, 2-hydroxyethyl methacrylate, 2-hydroxypropyl methacrylate, dimethylaminoethyl methacrylate, methyl chloride salts of dimethylaminoethyl methacrylate, diethylaminoethyl methacrylate, glycidyl methacrylate, tetrahydrofurfuryl methacrylate, allyl methacrylate, 2-ethoxyethyl methacrylate, 2-ethylhexyl acrylate, 2-ethoxyethyl acrylate, 2-ethoxyethoxyethyl acrylate, 2-hydroxyethyl acrylate, 2-hydroxypropyl acrylate, dicyclopentenylethyl acrylate, N-vinyl pyrrolidone and vinyl acetate.

monomers having two functional groups ethylene glycol dimethacrylate, triethylene glycol dimethacrylate, tetraethylene glycol dimethacrylate, 1, 3-butylene glycol dimethacrylate, 1, 6-hexanediol dimethacrylate, 1, 4-butanediol diacrylate, 1, 6-hexanediol diacrylate, 1, 9-nonanediol diacrylate, neopentyl glycol diacrylate, tetraethylene glycol diacrylate, tripropylene glycol diacrylate, polypropylene glycol diacrylate, diacrylate esters of an adduct of bisphenol A with ethylene oxide, glycerin methacrylate acrylate, diacrylate esters of an adduct of neopentyl glycol with two moles of propylene oxide, diethylene glycol diacrylate, polyethylene glycol (400) diacrylate, diacrylate esters of an ester of hydroxy pivalate and neopentyl glycol, 2, 2-bis(4-acryloyloxydiethoxyphenyl)propane, neopentyl glycol diadipate diacrylate, diacrylate esters of an adduct of neopentyl glycol hydroxypivalate with ϵ-caprolactone, 2-(2-hydroxy-1, 1-dimethylethyl)-5-hydroxymethyl-5-ethyl-1, 3-dioxane diacrylate, tricyclodecane dimethylol diacrylate, adducts of tricyclodecane dimethylol diacrylate with ϵ-caprolactone, and 1, 6-hexanediol glycidyl ether diacrylate.

monomers having three or more functional groups trimethylol propane trimethacrylate, trimethylol propane triacrylate, acrylate esters of an adduct of glycerin with propylene oxide, trisacryloyloxyethyl phosphate, pentaerythritol acrylate, triacrylate esters of an adduct of trimethylol propane with three moles of propylene oxide, dipentaerythritol polyacrylate, polyacrylate esters of an adduct of dipentaerythritol with ϵ-caprolactone, dipentaerythritol propionate triacrylate, triacrylate esters of hydroxypivalic aldehyde modified dimethylol propane, dipentaerythritol propionate tetraacrylate, ditrimethylol propane tetraacrylate, dipentaerythritol propionate pentaacrylate, dipentaerythritol hexaacrylate and adducts of dipentaerythritol hexaacrylate with ϵ-caprolactone.

oligomers adducts of bisphenol A with diepoxy acrylic acid.

When a resin is crosslinked using ultraviolet light, one or more of the following photopolymerization initiators and photopolymerization promoters can be used in the protective layer.

Specific examples of such photopolymerization initiators include:

benzoin ethers such as isobutyl benzoin ether, isopropyl benzoin ether, benzoin ethyl ether and benzoin methyl ether; α-acyloxime esters such as 1-phenyl-1, 2-propanedione-2-(o-ethoxycarbonyl)oxime; benzyl ketals such as 2, 2-dimethoxy-2-phenyl acetophenone and benzyl hydroxycyclohexylphenyl ketone; acetophenone derivatives such as diethoxy acetophenone and 2-hydroxy-2-methyl-1-phenylpropane-1-one; and ketones such as benzophenone, 1-chlorothioxanthone, 2-chlorothioxanthone, isopropylthioxanthone, 2-methylthioxanthone and 2-chlorobenzophenone. These photopolymerization initiators are employed alone or in combination.

The content of the photopolymerization initiator in the protective layer is preferably from about 0.005 to about 1.0 part by weight, and more preferably from about 0.01 to about 0.5 part by weight, per 1 part by weight of the crosslinking agent.

Suitable photopolymerization promoters include aromatic tertiary amines and aliphatic amines. Specific examples of such photopolymerization promoters which are employed alone or in combination include p-dimethylamino benzoic acid isoamyl ester, p-dimethylamino benzoic acid ethyl ester and the like. The content of the photopolymerization promoter in the protective layer is preferably from about 0.1 to about 5 parts by weight, and more preferably from about 0.3 to about 3 parts by weight, per 1 part by weight of the photopolymerization initiator.

Suitable light sources useful for irradiating ultraviolet light include mercury-vapor lamps, metal-halide lamps, gallium lamps, mercury-xenon lamps, flush lamps and the like. The light source should be selected so that the spectrum of the ultraviolet light irradiated from the light source corresponds to the absorption spectrum of the photopolymerization initiator and the photopolymerization promoter included in the protective layer. Irradiation conditions of ultraviolet light such as output of lamp power, irradiation width and feeding speed (i.e., irradiation time) should be determined so that the resin in the protective layer can be securely crosslinked.

Electron beam irradiation apparatus includes scanning type and non-scanning type electron beam irradiation apparatus which is selected depending on the irradiation area and the irradiation-dose required for cross linking the protective layer. Irradiation conditions such as electron beam current, irradiation width and irradiation speed should be determined depending on the irradiation dose required for crosslinking the resin included in the protective layer.

The protective layer may include a resin other than the crosslinked resin. Specific examples of such a resin include polyvinyl alcohol resins, styrene-maleic anhydride copolymers, carboxyl modified polyethylene resins, melamine-formaldehyde resins and urea-formaldehyde resins.

The protective layer may include an electroconductive agent such as the electroconductive agents which are described in the recording layer. When the electroconductive agents are used in the protective layer, stick-preventing agents are preferably used together with the electroconductive agents to prevent the recording material from charging caused by a thermal printhead and sticking to a thermal printhead.

Suitable stick-preventing agents include cationic polymers, silicone resins, fluorine-containing resins, phosphate compounds and polyoxyethylene compounds. Cationic polymers can be used as an electroconductive agent and a stick-preventing agent.

The protective layer of the recording material of the present invention may include a filler to improve the feeding properties and the wearing resistance of the recording material and to prevent the recording material from sticking to a thermal printhead. Specific examples of such a filler include the organic or the inorganic fillers described in the recording layer.

The protective layer may include a lubricant to improve the feeding properties and the wearing resistance of the recording material and to prevent the recording material from sticking to a thermal printhead. Specific examples of such a lubricant include waxes such as stearic acid amide, zinc stearate, palmitic acid amide, oleic acid amide, lauric acid amide, ethylenebisstearyl amide, methylenebisstearyl amide, methylol stearyl amide, paraffin waxes, polyethylene waxes, higher alcohols, higher fatty acids and higher fatty acid esters. These lubricants are employed alone or in combination. The content of the lubricant in the protective layer is from about 1 to about 50 parts by weight per 100 parts by weight of the resin of the protective layer.

The protective layer may include an auxiliary agent such as ultraviolet absorbing agents and the like.

A suitable substrate for use in the recording material of the present invention includes any substrate which can support the recording layer, such as paper, resin films, synthetic paper, metal foils, glass plates or complex substrates thereof. The substrate may be non-colored or colored and may be transparent or opaque. Preferably the substrate is white colored to obtain good contrast of recorded images. The thickness of the substrate is preferably from 5 to 500 μm.

The recording material of the present invention may include an adhesive layer, an intermediate layer, an under-coat layer, a back-coat layer and a magnetic recording layer other than the recording layer and the protective layer formed on the recording layer. These layers may be colored or non-colored.

An intermediate layer is preferably formed between the recording layer and the protective layer to obtain good adhesion thereof and to prevent the recording layer from deteriorating, which is caused by the coating operation of the protective layer and the migration of a component included in the protective layer. The intermediate layer and the protective layer preferably have relatively low oxygen transmittance to obtain good light resistance of the recorded image by preventing the coloring agent and the coloring developer from oxidizing caused by contacting with oxygen.

The recording material may include an under-coat layer between the substrate and the recording layer to effectively utilize heat applied for recording images, to obtain good adhesion between the recording layer and the substrate and/or to prevent the substrate from deteriorating caused by contacting with the recording layer coating liquid. The heat insulating under-coat layer can be formed by coating a coating liquid in which hollow particles are dispersed in a resin solution.

Suitable resins for use in the intermediate layer or the under-coat layer include resins which are described in the recording layer. In addition, the recording layer, the protective layer, the intermediate layer and the under-coat layer may include an inorganic or an organic filler such as calcium carbonate, magnesium carbonate, titanium dioxide, silica, aluminum hydroxide, kaolin, talc and the like. Further, these layers may include lubricants, surfactants and the like.

The recording material of the present invention may be adhered to a supporting material with an adhesive layer therebetween. The adhesive layer may be formed on a part of the recording material or on the entire recording material. The recording material which is adhered to a supporting material may be laminated with films or the like.

In addition, the recording material of the present invention may have a print layer thereon. The print layer can be formed, for example, by offset printing, gravure printing, ink jet printing, thermal transfer printing, sublimation thermal transfer printing or the like. Further, the print layer and the recording material having the print layer may be covered entirely or partially by a protective layer (an overprint layer, i.e., an OP layer) which includes a crosslinked resin. Furthermore, the shape of the recording material may be card shaped, relatively large sheet shaped, roll shaped or the like.

Images can be recorded in the recording material of the present invention by heating the recording material, for example, with a thermal pen, a thermal printhead, laser or the like, at a temperature (referred to as an image forming temperature) for a short time. When the heating is stopped, the applied heat is quickly diffused, namely, the recorded image is quickly cooled; thereby a stable image can be formed in the recording material. The quick cooling operation is needed to prevent the coloring agent and coloring developer from crystallizing or to prevent the coloring agent and coloring developer from separating into each phase. The recorded image can be erased by heating the recorded image with an appropriate heating device for a relatively long time and then gradually cooling the recording material or by preserving the recording material for a short time at a temperature (referred to as an image erasing temperature) which is slightly lower than the image forming temperature. Concretely, the recorded image can be erased by gradually cooling the recording material which is heated at an image forming temperature or by heating the recording material for a short time at a temperature which is lower than the image forming temperature. When the entire recording material is heated for a relatively long time, it takes a relatively long time for the recording material to be cooled, and therefore the recorded image is erased during the cooling process. Namely, when the recording material is settled under room temperature condition after the imagewise heating of the recording material for recording an image or the heating of the entire recording material for erasing an image is stopped, the recorded image is stably maintained and the image to be erased is completely erased. This is because the recorded image is quickly cooled and the image to be erased is gradually cooled. A suitable cooling speed of the quick cooling or the gradual cooling for forming or erasing images depends on the combination of the coloring agent and the coloring developer. A suitable heating device useful for erasing images includes heaters such as a heat bar, a heat roller or the like; hot air blowing devices; incubators; infrared irradiating devices; or thermal printheads. The temperature of these heating devices for erasing images should be controlled. When a thermal printhead is used for erasing images, an applied energy which is relatively low compared to an applied energy for recording images should be applied to the recording material by controlling the applied voltage and/or pulse width of a pulse applied to the thermal printhead. By using this method, the image recording and the image erasing operations can be performed with one thermal printhead.

The recording material of the present invention may be a complex recording material in which a reversible thermosensitive recording layer and another recording layer are formed on a substrate such as, for example, a complex recording material having a reversible thermosensitive recording layer and a magnetic recording layer. In conventional pre-paid cards having a magnetic recording layer, information stored in the cards cannot be known unless the cards are passed through a card reader. The recording material of the present invention can display information such as the balance remaining on a pre-paid card and therefore the recording material is suitable as a display for the pre-paid cards. Particularly, the recording material of the present invention can form a variety of color images, and therefore the recording material can be widely used as displays.

A complex recording material having a reversible thermosensitive recording layer and a magnetic recording layer is hereinafter described.

The magnetic recording layer and the reversible thermosensitive recording layer may be formed at different areas on the same surface of a substrate; however, preferably they are overlaid on an area on a surface of a substrate so that the reversible thermosensitive recording layer is formed overlying the magnetic recording layer to minimize the size of the complex recording material. In the recording material, information can independently be recorded in an area of the recording material. When information is recorded in the magnetic recording layer, the distance between a magnetic recording head and the magnetic recording layer is preferably less than about 10 $\mu$m to securely record and erase information. Namely, when layers such as a reversible thermosensitive recording layer and a second protective layer are formed on the magnetic recording layer, the total thickness of the layers is less than 10 $\mu$m, and preferably less than about 8 $\mu$m. The magnetic recording layer for use in the recording material of the present invention can be formed on the recording material by depositing a magnetic material by a vacuum evaporation method or a sputtering method, or by coating a coating liquid including a binder resin and a magnetic material on the recording material and drying the coated liquid.

Suitable magnetic materials for use in the magnetic recording layer include known magnetic materials such as iron, cobalt, nickel, alloys thereof and the like. Suitable binder resins for use in the magnetic recording layer include known resins such as thermoplastic resins, thermosetting resins, radiation crosslinkable resins and the like.

Suitable materials for use in the second protective layer include known resins, transparent metal oxides and the like. When a coating liquid is coated on the recording layers, the solvent in the coating liquid should be carefully selected so as not to deteriorate the recording layers. The complex recording material can be used for credit cards, cash cards and the like and used as a notebook and the like as well as pre-paid cards.

The material of the reversible thermosensitive recording layer can be used for toner which is used for forming images using electrophotography, ink used for ink jet recording method, thermal transfer recording method and the like as well as for the display. Images recorded by the reversible thermosensitive material using these recording methods can be easily perceived visually and erased.

In addition, the recording layer of the present invention can be used for a heat-mode rewritable optical recording material.

Further, the recording layer of the present invention can be used for high density display, projection type large size display and the like.

The optical recording material for high density displays can be manufactured by forming a reversible thermosensitive recording layer on a substrate and then forming a protective layer thereon. Suitable substrates include glass plates, acrylic resin plates, polycarbonate resin plates and the like. Suitable materials for use in the protective layer include glass and resins which are transparent against recording light, reproducing light and erasing light.

Recording to the optical recording material is performed by laser light.

The recording layer of the optical recording material can be formed as follows:

(1) solvent coating method (a) a coloring agent, a coloring developer and a binder resin are dispersed or dissolved in a solvent and mixed, and if desired, the mixture is dispersed in a ball mill, to prepare a coating liquid, and (b) the coating liquid is coated on a substrate by a spin coating method, a dip coating method or the like and dried to form a recording layer; and (2) solvent-less coating method (a) a coloring agent and a coloring developer are melted to prepare a melted coating liquid, and (b) the melted coating liquid is coated on a heated substrate and cooled to form a recording layer.

The recording layer formed by the method (2) is a layer in which the coloring agent and a coloring developer are crystallized and are not dispersed as particles, and therefore high density recording can be performed.

The optical recording material using the recording material of the present invention utilizes a coloring reaction of a coloring agent and a coloring developer, and is broadly classified into the following two types:

(1) information is stored by making a colored spot in a recording layer which is in an image erased state (non-colored state); and (2) information is stored by making a non-colored spot in a recording layer which is in a colored state.

When the method (1) is used, the non-colored state can be formed as follows:

(a) a recording layer which is melted and colored at a temperature higher than an image forming temperature is gradually cooled to make the recording layer be in a non-colored state; or (b) a recording layer which is melted and colored at a temperature higher than an image forming temperature is rapidly cooled to make the recording layer be in a colored state, and then heated to an image erasing temperature and then cooled to make the recording layer be in a non-colored state.

The method (b) is preferable because an even non-colored state can be obtained.

When the method (2) is used, the colored state can be formed by heating the recording layer at an image forming temperature and then rapidly cooling the recording layer.

Having generally described this invention, a further understanding can be obtained by reference to certain specific examples which are provided herein for purposes of illustration only and are not intended to be limiting. In the descriptions in the following examples, numbers represent weight ratios in parts, unless otherwise specified.

EXAMPLES

Example 1

(Formation of recording layer)

A mixture of the following compounds was pulverized and dispersed in a ball mill in order that the average particle diameter of the solid components in the liquid was from 1 to 4 μm, thus a liquid A was prepared:

| (Formulation of liquid A) | |
|---|---|
| 2-anilino-3-methyl-6-dibutylaminofluoran | 2 |
| 15% phenoxy resin solution (PKHH, manufactured by Union Carbide Corp., was dissolved in methyl ethyl ketone) | 150 |
| coloring developer having the following formula | 8 |

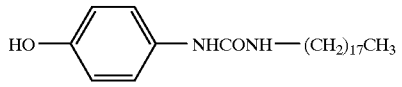

The following compounds were mixed to prepare a recording layer coating liquid.

| (Formulation of recording layer coating liquid) | |
|---|---|
| liquid A | 160 |
| adduct type hexamethylene diisocyanate (Colonate HL, manufactured by Nippon Polyurethane Industry Co., Ltd., ethyl acetate solution having a solid content of 75%) | 20 |

The recording layer coating liquid was coated with a wire bar on a substrate of a polyethylene terephthalate (PET) film having a thickness of 100 μm, dried at 80° C., and heated for 10 minutes at 100° C. and for 24 hours at 60° C. to form a recording layer of 6.0 μm in a dry thickness.

(Formation of protective layer)

The following compounds were mixed to prepare a protective layer coating liquid:

| (Formulation of protective layer coating liquid) | |
|---|---|
| urethane acrylate type ultraviolet light crosslinkable resin (C7-157, manufactured by Dainippon Ink and Chemicals Inc.) | 10 |
| ethyl acetate | 90 |

The prepared protective layer coating liquid was coated on the previously prepared recording layer with a wire bar, dried and then fed under an ultraviolet light radiation lamp, whose irradiation power was 80 W/cm, at a feeding speed of 9 m/min to obtain a crosslinked protective layer having a thickness of 3 $\mu$m.

Thus, a reversible thermosensitive recording material of the present invention was obtained.

(Image recording method)

An image was recorded in the recording material using a thermal recording apparatus, manufactured by Ohkura Electric Co., Ltd., under the condition that the voltage applied to a thermal printhead was 13.3 v and the pulse width was 1.2 ms. The image density of the recorded image which was measured with Macbeth reflection densitometer RD914 was 0.91. The recorded image was then kept for 10 seconds in an oven heated at 100° C. to erase the image. The optical density of the recording material after the image was erased was 0.10. The recording material remained in a good state without deformation of the recording material even after the above-mentioned recording/erasing operation was repeated 50 times.

Example 2

The procedures for preparation of the recording material and for recording/erasing of the image in Example 1 were repeated except that the phenoxy resin solution was replaced with a 15% tetrahydrofuran solution of a polyester polyol resin (Takerac U-21, manufactured by Takeda Chemical Industries Inc.).

The image density of the recorded image was 1.05. The optical density of the recording material after the image was erased was 0.10. The recording material remained in a good state without deformation of the recording material even after the above-mentioned recording/erasing operation was repeated 50 times.

Example 3

The procedures for preparation of the recording material and for recording/erasing of the image in Example 1 were repeated except that the phenoxy resin solution was replaced with a 15% methyl ethyl ketone solution of a polyurethane polyol resin (Takerac E-550, manufactured by Takeda Chemical Industries Inc.).

The image density of the recorded image was 1.05. The optical density of the recording material after the image was erased was 0.10. The recording material remained in a good state without deformation of the recording material even after the above-mentioned recording/erasing operation was repeated 50 times.

Example 4

The procedures for preparation of the recording material and for recording/erasing of the image in Example 1 were repeated except that the phenoxy resin solution was replaced with a 15% tetrahydrofuran solution of an acryl polyol resin (LR-286, manufactured by Mitsubishi Rayon Co., Ltd.).

The image density of the recorded image was 1.02. The optical density of the recording material after the image was erased was 0.08. The recording material remained in a good state without deformation of the recording material even after the above-mentioned recording/erasing operation was repeated 50 times.

Example 5

The procedures for preparation of the recording material and for recording/erasing of the image in Example 1 were repeated except that the phenoxy resin solution was replaced with a 15% methyl ethyl ketone solution of a vinyl chloride-vinyl acetate-vinyl alcohol copolymer (VAGH, manufactured by Union Carbide Corp.).

The recording material remained in a good state without deformation of the recording material even after the above-mentioned recording/erasing operation was repeated 50 times.

Example 6

The procedures for preparation of the recording material and for recording/erasing of the image in Example 1 were repeated except that the phenoxy resin solution was replaced with a 15% methyl ethyl ketone solution of polyvinyl butyral resin.

The recording material remained in a good state without deformation of the recording material even after the above-mentioned recording/erasing operation was repeated 50 times.

Example 7

The procedures for preparation of the recording material and for recording/erasing of the image in Example 1 were repeated except that 2-anilino-3-methyl-6-dibutylaminofluoran was replaced with 3-(4-diethylamino-2-ethoxyphenyl)-3-(1-ethyl-2-methylindole-3-yl)-4-azaphthalide.

The image density of the recorded image was 1.02. The optical density of the recording material after the image was erased was 0.09. The recording material remained in a good state without deformation of the recording material even after the above-mentioned recording/erasing operation was repeated 50 times. In addition, the recorded image was clearly erased by the image erasing operation performed in Example 1 after the image was irradiated with light of 5500 lux for 100 hours using a fluorescent lamp.

Example 8

The procedures for preparation of the recording material and for recording/erasing of the image in Example 1 were repeated except that 2-anilino-3-methyl-6-dibutylaminofluoran was replaced with 3, 3-bis(2-ethoxy-4-diethylaminophenyl)-4-azaphthalide.

The image density of the recorded image was 0.97. The optical density of the recording material after the image was erased was 0.09. The recording material remained in a good state without deformation of the recording material even after the above-mentioned recording/erasing operation was repeated 50 times. In addition, the recorded image was clearly erased by the image erasing operation performed in Example 1 after the image was irradiated with light of 5500 lux for 100 hours using a fluorescent lamp.

Example 9

The procedures for preparation of the recording material and for recording/erasing of the image in Example 1 were repeated except that 2-anilino-3-methyl-6-dibutylaminofluoran was replaced with 3-(4-diethylamino-2-ethoxyphenyl)-3-(1-ethyl-2-methylindole-3-yl)-4-azaphthalide and the coloring developer was replaced with a compound having the following formula:

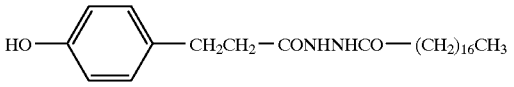

The image density of the recorded image was 0.85. The optical density of the recording material after the image was erased was 0.09. The recording material remained in a good state without deformation of the recording material even after the above-mentioned recording/erasing operation was repeated 50 times. In addition, the recorded image was clearly erased by the image erasing operation performed in Example 1 after the image was irradiated with light of 5500 lux for 100 hours using a fluorescent lamp.

Example 10

The procedures for preparation of the recording material and for recording/erasing of the image in Example 1 were repeated except that 2-anilino-3-methyl-6-dibutylaminofluoran was replaced with 3-(4-diethylamino-2-ethoxyphenyl)-3-(1-ethyl-2-methylindole-3-yl)-4-azaphthalide, the coloring developer was replaced with a compound having the following formula and the recording material was heated for 10 minutes at 130° C. and for 24 hours at 60° C. after the recording layer coating liquid was dried at 80° C.

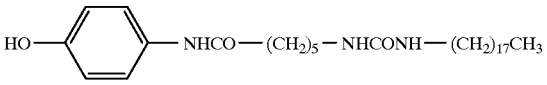

The image density of the recorded image was 0.95. The optical density of the recording material after the image was erased for 10 seconds in an oven of 130° C. was 0.08. The recording material remained in a good state without deformation of the recording material even after the above-mentioned recording/erasing operation was repeated 50 times. In addition, the recorded image was clearly erased by the image erasing operation performed in Example 1 after the image was irradiated with light of 5500 lux for 100 hours using a fluorescent lamp.

Example 11

The procedures for preparation of the recording material and for recording/erasing of the image in Example 1 were repeated except that 2-anilino-3-methyl-6-dibutylaminofluoran was replaced with 3-(4-diethylamino-2-ethoxyphenyl)-3-(1-ethyl-2-methylindole-3-yl)-4-azaphthalide, the coloring developer was replaced with a compound having the following formula and the recording material was heated for 10 minutes at 130° C. and for 24 hours at 60° C. after the recording layer coating liquid was dried at 80° C.

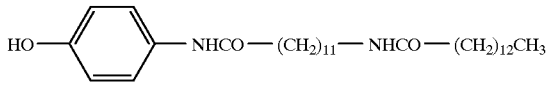

The image density of the recorded image was 0.92. The optical density of the recording material after the image was erased for 10 seconds in an oven of 130° C. was 0.09. The recording material remained in a good state without deformation of the recording material even after the above-mentioned recording/erasing operation was repeated 50 times. In addition, the recorded image was clearly erased by the image erasing operation performed in Example 1 after the image was irradiated with light of 5500 lux for 100 hours using a fluorescent lamp.

Example 12

The procedures for preparation of the recording material and for recording/erasing of the image in Example 1 were repeated except that the protective layer was not formed.

The image density of the recorded image was 0.93. The optical density of the recording material after the image was erased was 0.09. The recording material remained in a good state without deformation of the recording material even after the above-mentioned recording/erasing operation was repeated 50 times.

Example 13

The procedures for preparation of the recording material and for recording/erasing of the image in Example 1 were repeated except that 2-anilino-3-methyl-6-dibutylaminofluoran was replaced with 3, 3-bis(p-diethylaminophenyl)-6-dimethylaminophthalide.

The image density of the recorded image was 0.83. The optical density of the recording material after the image was erased was 0.09. The recording material remained in a good state without deformation of the recording material even after the above-mentioned recording/erasing operation was repeated 50 times.

Example 14

A mixture of the following compounds was pulverized and dispersed in a ball mill in order that the average particle diameter of the solid components in the liquid was from 1 to 4 μm. Thus, a liquid B was prepared.

| (Formation of liquid B) | |
|---|---|
| 2-amino-3-methyl-6-diethylaminofluoran | 2 |
| coloring developer having the following formula | 6 |

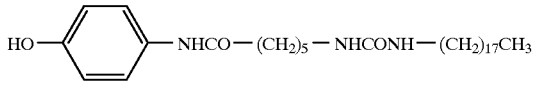

| | |
|---|---|
| dioctadecyl urea | 2 |
| 15% acryl polyol resin solution (copolymer of 25% by weight of 2-hydroxyethyl methacrylate, 35% by weight of styrene, 20% by weight of methyl methacrylate and 20% by weight of iso-butyl methacrylate having a glass transition temperature of 80° C. was dissolved in tetrahydrofuran) | 70 |

An adduct type hexamethylene diisocyanate compound (Colonate HL) was added to liquid B to prepare a recording layer coating liquid in an amount of 5 parts.

The recording layer coating liquid was coated with a wire bar on a white polyethylene terephthalate film 188 μm thick which has a magnetic layer on the back side, dried at 100° C. and then heated for 72 hours at 60° C. to obtain a recording layer having a thickness of 8.0 μm.

A protective layer was formed on the recording layer by the operation performed in Example 1.

An image was recorded using a card printer having a thermal printhead and a ceramic heater 2 mm wide. When an electric power of 0.6 mJ/dot was applied to the thermal printhead, the image density of the recorded image was 1.25. The recorded image was then erased with the ceramic heater which was heated at 130° C. while the recording material was fed at 20 mm/sec; the residual image density (which means difference between the density after the image was erased and the background density of the recording material) was 0.01.

The recording material remained in a good state without deformation of the recording material even after the above-mentioned image formation/erasure operation was repeated 50 times.

Example 15

An intermediate layer coating liquid whose formulation is as follows was prepared and coated on the recording layer which was prepared in Example 14, and dried to form an intermediate layer having a thickness of 1 μm.

| (Formulation of intermediate layer) | |
|---|---|
| super fine zinc oxide powder (average particle diameter of 20 nm) | 5 |
| 15% acryl polyol resin solution (copolymer of 15% by weight of 2-hydroxyethyl methacrylate, 35% by weight of styrene, and 50% by weight of methyl methacrylate having a glass transition temperature of 81° C. was dissolved in methyl ethyl ketone) | 25 |
| Colonate HL | 2 |

A protective layer was formed on the intermediate layer by the operation performed in Example 14. The image density of the recorded image was 1.22 and the residual image density was 0.01.

The recording material remained in a good state without deformation of the recording material even after the above-mentioned image formation/erasure operation was repeated 50 times.

In addition, the recorded image was irradiated for 100 hours with light of 5,000 lux of a fluorescent lamp and then the recorded image was erased by the operation performed in Example 14. The recorded image remained in a good state even after the light irradiation test, and the residual image density was 0.01 which was the same value as that of the recording material before the light irradiation test.

Example 16

The procedure for preparation of the recording material in Example 15 was repeated and then an OP varnish (an overprint varnish, manufactured by Dainippon Ink and Chemicals Inc.) was printed on the protective layer using an RI tester and irradiated with ultraviolet light to form a recording material having an overprint layer 2 μm thick.

When the procedure for image formation/erasure operation in Example 14 was repeated, the image density was 1.24 and the residual image density was 0.01. The recording material remained in a good state without deformation of the recording material even after the above-mentioned image formation/erasure operation was repeated 100 times.

When the procedure for light irradiation test in Example 15 was repeated, the recorded image remained in a good state and the residual image density was 0.01.

Example 17

The procedure for preparation of the recording layer in Example 14 was repeated except that the acryl polyol copolymer was replaced with an acryl polyol copolymer of 15% by weight of 2-hydroxyethyl methacrylate, 35% by weight of styrene and 50% by weight of methyl methacrylate.

An intermediate layer coating liquid whose formulation is as follows was coated on the recording layer and dried to form an intermediate layer having a thickness of 1 μm.

| (Formulation of intermediate layer coating liquid) | |
|---|---|
| 2-(2'-hydroxy-3,5-di-t-amylphenyl)benzotriazole | 0.2 |
| 15% acryl polyol resin solution (copolymer of 15% by weight of 2-hydroxyethyl methacrylate, 35% by weight of styrene, and 50% by weight of methyl methacrylate having a glass transition temperature of 81° C. was dissolved in methyl ethyl ketone) | 25 |
| Colonate HL | 2 |

A protective layer was formed on the intermediate layer by the operation performed in Example 1 and then heated for 48 hours at 60° C. to obtain a recording material.

When the procedure for image formation/erasure operations in Example 14 was repeated, the image density was 1.25 and the residual image density was 0.01. The recording material remained in a good state without deformation of the recording material even after the above-mentioned image formation/erasure operation was repeated 50 times.

When the procedure for light irradiation test in Example 15 was repeated, the recorded image remained in a good state and the residual image density was 0.01.

Example 18

The procedure for preparation of the recording layer in Example 14 was repeated except that the acryl polyol copolymer was replaced with an acryl polyol copolymer of 15% by weight of 2-hydroxyethyl methacrylate, 70% by weight of methyl methacrylate and 15% by weight of n-butyl methacrylate, having a glass transition temperature of 80° C.

An intermediate layer and a protective layer were formed by the operation performed in Example 15 and then heated at for 48 hours at 60° C. to obtain a recording material.

When the procedure for image formation/erasure operations in Example 14 was repeated, the image density was 1.23 and the residual image density was 0.01. The recording material remained in a good state without deformation of the recording material even after the above-mentioned image formation/erasure operation was repeated 50 times.

When the procedure for light irradiation test in Example 15 was repeated, the recorded image remained in a good state and the residual image density was 0.01.

Comparative Example 1

The procedures for preparation of the recording material and for recording/erasing of the image in Example 1 were repeated except that the phenoxy resin solution was replaced with a 15% methyl ethyl ketone solution of a vinyl chloride-vinyl acetate copolymer (VYHH, manufactured by Union Carbide Corp.) and the isocyanate compound, Colonate HL, was eliminated from the recording layer coating liquid.

The image density of the recorded image was 0.90. The optical density of the recording material after the image was erased was 0.10. The deformation of the recorded image occurred from the first image recording/erasing operation, and after the above-mentioned recording/erasing operation was repeated 50 times, an-image having good evenness could not be recorded because of the deformation of the recording material.

Additional modifications and variations of the present invention are possible in light of the above teachings. It is therefore to be understood that within the scope of the appended claims the invention may be practiced other than as specifically described herein.

This application is based on Japanese Patent Application No. 08-354658, filed on Dec. 20, 1996, the entire contents of which are herein incorporated by reference.

What is claimed is:

1. A reversible thermosensitive recording material which comprises a recording layer which is formed overlying a substrate and which comprises a resin, an isocyanate compound, an electron donating coloring agent and an electron accepting coloring developer and in which the recording layer becomes a colored state when heated at a temperature higher than or equal to an image forming temperature and then cooled at a cooling speed (1) and in which the colored state of the recording layer then becomes a non-colored state when heated at a temperature below the image forming temperature and higher than or equal to an image erasing temperature, or when heated at a temperature higher than or equal to the image forming temperature and then cooled relatively slowly compared to the cooling speed (1), wherein the resin comprises a resin crosslinked with the isocyanate compound.

2. The reversible thermosensitive recording material of claim 1, wherein the resin comprises a resin having a hydroxy group, and wherein the resin having a hydroxy group is crosslinked with the isocyanate compound.

3. The reversible thermosensitive recording material of claim 2, wherein the resin having a hydroxy group comprises at least one of acryl polyol resins, polyester polyol resins and polyurethane polyol resins.

4. The reversible thermosensitive recording material of claim 3, wherein the resin having a hydroxy group comprises an acryl polyol resin in which at least a monomer having a hydroxy group, a styrene monomer and a methyl methacrylate monomer are copolymerized.

5. The reversible thermosensitive recording material of claim 4, wherein the monomer having a hydroxy group is copolymerized in the acryl polyol resin in an amount of greater than about 20% by weight.

6. The reversible thermosensitive recording material of claim 3, wherein the resin having a hydroxy group comprises an acryl polyol resin in which at least a monomer having a hydroxy group, a styrene monomer, a methyl methacrylate monomer and a butyl methacrylate monomer are copolymerized.

7. The reversible thermosensitive recording material of claim 3, wherein the resin having a hydroxy group comprises an acryl polyol resin in which a plurality of monomers are copolymerized, and wherein the monomers comprise a monomer which has a glass transition temperature lower than about 20° C. when only the monomer is polymerized and which is included in the acryl polyol resin in an amount of less than about 10% by weight.

8. The reversible thermosensitive recording material of claim 3, wherein the resin having a hydroxy group comprises an acryl polyol resin in which a plurality of monomers are copolymerized, and wherein the monomers comprise a monomer which has a glass transition temperature higher than about 20° C. when only the monomer is polymerized and which is included in the acryl polyol resin in an amount of greater than about 70% by weight.

9. The reversible thermosensitive recording material of claim 3, wherein the acryl polyol resin has a glass transition temperature greater than about 70° C.

10. The reversible thermosensitive recording material of claim 1, wherein the isocyanate compound comprises at least one of an adduct compound, a buret compound and a trimer compound of hexamethylene diisocyanate.

11. The reversible thermosensitive recording material of claim 1, wherein the recording material further comprises a protective layer which is formed overlying the recording layer and which comprises a crosslinked resin.

12. The reversible thermosensitive recording material of claim 11, wherein the protective layer further comprises a filler.

13. The reversible thermosensitive recording material of claim 11, wherein the protective layer further comprises a lubricant.

14. The reversible thermosensitive recording material of claim 11, wherein the protective layer further comprises an electroconductive cationic polymer.

15. The reversible thermosensitive recording material of claim 11, wherein the recording material further comprises an intermediate layer which is formed between the recording layer and the protective layer.

16. The reversible thermosensitive recording material of claim 1, wherein the electron-donating coloring agent comprises a fluoran compound having the following formula (1):

(1)

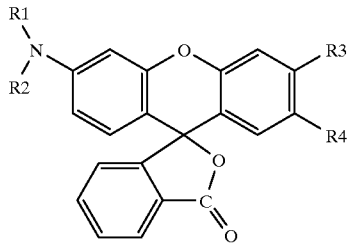

wherein R1 and R2 independently represent a lower alkyl group, an aryl group, a substituted aryl group or a hydrogen atom, and R1 and R2 may combine with each other to form a ring, R3 represents a lower alkyl group, a halogen atom or a hydrogen atom, and R4 represents a lower alkyl group, a halogen atom, a hydrogen atom or a substituted anilino group having the following formula (2):

(2)

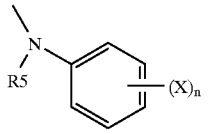

wherein R5 represents a lower alkyl group or a hydrogen atom, X represents a lower alkyl group or a halogen atom, and n is 0, 1, 2 or 3.

17. The reversible thermosensitive recording material of claim 1, wherein the electron-donating coloring agent comprises an azaphthalide compound having the following formula (3):

(3)

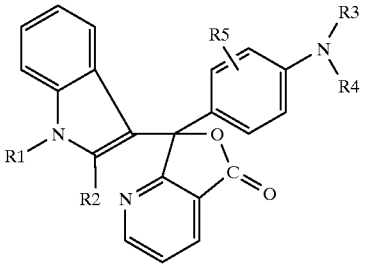

wherein R1, R2, R3 and R4 independently represent an alkyl group or a hydrogen atom, and R5 represents an alkyl group, an alkoxy group or a hydrogen atom.

18. The reversible thermosensitive recording material of claim 1, wherein the electron-donating coloring agent comprises an azaphthalide compound having the following formula (4):

(4)

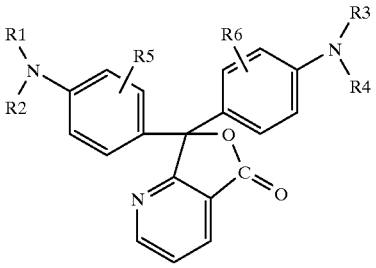

wherein R1, R2, R3 and R4 independently represent a lower alkyl group or a hydrogen atom, and R5 and R6 independently represent an alkyl group, an alkoxy group or a hydrogen atom.

19. The reversible thermosensitive recording material of claim 1, wherein the electron-accepting coloring developer comprises a phenolic compound having the following formula (5):

(5)

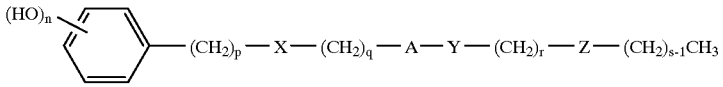

wherein p, q and r are independently 0 or an integer, s is an integer and A, X, Y and Z independently represent a direct bonding or a divalent group.

20. The reversible thermosensitive recording material of claim 1, wherein the recording layer further comprises a filler.

21. The reversible thermosensitive recording material of claim 1, wherein the recording layer further comprises an electroconductive cationic polymer.

22. The reversible thermosensitive recording material of claim 1, wherein the substrate is transparent.

23. The reversible thermosensitive recording material of claim 1, wherein the substrate is white colored.

24. The reversible thermosensitive recording material of claim 1, wherein the reversible thermosensitive recording material further comprises a magnetic recording layer.

25. The reversible thermosensitive recording material of claim 24, wherein the substrate has two or more surfaces and wherein the recording layer and the magnetic recording layer are formed on the same surface of the substrate.

26. The reversible thermosensitive recording material of claim 25, wherein the recording layer is formed overlying the magnetic recording layer.

27. The reversible thermosensitive recording material of claim 26, wherein the thickness of a part of the reversible thermosensitive recording material which overlies the magnetic recording layer is less than about 10 $\mu$m.

28. The reversible thermosensitive recording material of claim 24, wherein the substrate has two or more surfaces and wherein each of the recording layer and the magnetic recording layer is formed on a different surface of the substrate.

29. The reversible thermosensitive recording material of claim 1, wherein the reversible thermosensitive recording material is one of pre-paid cards, credit cards, cash cards and notebooks.

30. A coating liquid for forming a reversible thermosensitive recording layer of a reversible thermosensitive recording material, the coating liquid comprising an electron-donating coloring agent, an electron-accepting coloring developer, a resin, an isocyanate compound which can react with the resin to form a crosslinked resin, and a solvent, wherein the solvent comprises a solvent which does not react with the isocyanate compound.

31. A display material for displaying an image comprising a substrate, a reversible thermosensitive recording layer which is formed overlying the substrate and which comprises a resin, an isocyanate compound, an electron donating coloring agent and an electron accepting coloring developer and in which the recording layer becomes a colored state when heated at a temperature higher than or equal to an image forming temperature and then cooled at a cooling speed (1) and in which the colored state of the recording layer then becomes a non-colored state when heated at a temperature below the image forming temperature and higher than or equal to an image erasing temperature, or when heated at a temperature higher than or equal to the image forming temperature and then cooled relatively slowly compared to the cooling speed (1), wherein the resin comprises a resin crosslinked with the isocyanate compound.

32. A method for manufacturing a reversible thermosensitive recording material comprising the steps of:

preparing a recording layer coating liquid comprising a resin, an isocyanate compound, an electron donating coloring agent and an electron accepting coloring developer;

coating the recording layer coating liquid on a substrate;

drying the coated recording layer coating liquid to form a recording layer in which the recording layer becomes a colored state when heated at a temperature higher than or equal to an image forming temperature and then cooled at a cooling speed (1) and in which the colored state of the recording layer then becomes a non-colored state when heated at a temperature below the image forming temperature and higher than or equal to an image erasing temperature, or when heated at a temperature higher than or equal to the image forming temperature and then cooled relatively slowly compared to the cooling speed (1); and cooling the recording layer to manufacture a reversible thermosensitive recording material, wherein the recording material is at least once in a colored state and then becomes a non-colored state.

33. The method for manufacturing a reversible thermosensitive recording material of claim 32, wherein the coated recording layer coating liquid is dried at a temperature below the image forming temperature and then the recording material is at least once in a colored state and then becomes a non-colored state.

34. The method for manufacturing a reversible thermosensitive recording material of claim 32, wherein the coated recording layer coating liquid is dried at a temperature higher than or equal to the image forming temperature so that the recording material is in a colored state.

35. A reversible thermosensitive recording method comprising the steps of:

preparing a reversible thermosensitive recording material which comprises a substrate, a recording layer which is formed on the substrate and which comprises a resin, an isocyanate compound which reacts with the resin to form a crosslinked resin, an electron donating coloring agent and an electron accepting coloring developer, and optionally comprises a protective layer which is formed overlying the recording layer, wherein the recording layer becomes a colored state when heated at a temperature higher than or equal to an image forming temperature and then cooled at a cooling speed (1), and the colored state of the recording layer becomes a non-colored state when heated at a temperature below the image forming temperature and higher than or equal to an image erasing temperature or when heated at a temperature higher than or equal to the image forming temperature and then cooled relatively slowly compared to the cooling speed (1);

imagewise heating the recording layer with a heating device (1) at a temperature higher than or equal to the image forming temperature and then cooling the recording layer at the cooling speed (1) to form an image; and then heating the recording layer with a heating device (2) at a temperature below the image forming temperature and higher than or equal to the image erasing temperature or heating the recording layer with a heating device at a temperature higher than or equal to the image forming temperature and then cooling relatively slowly compared to the cooling speed (1) to erase the image.

36. The reversible thermosensitive recording method of claim 35, wherein the heating device (1) is one of a thermal pen, a thermal printhead and laser light.

37. The reversible thermosensitive recording method of claim 35, wherein the heating device (2) is one of a heat roller, a heat bar, a hot air blowing device, an incubator, an infrared irradiating device and a thermal printhead.

38. The reversible thermosensitive recording method of claim 35, wherein the heating device (1) is a thermal printhead and the heating device (2) is one of a heat roller, a heat bar, a hot air blowing device, an incubator, an infrared irradiating device and a thermal printhead.

39. The reversible thermosensitive recording method of claim 35, wherein the heating device (2) can be controlled in temperature.

40. A reversible thermosensitive recording method comprising the steps of:

preparing a reversible thermosensitive recording material which comprises a substrate, a recording layer which is formed on the substrate and which comprises a resin, an isocyanate compound which reacts with the resin to form a crosslinked resin, an electron donating coloring agent and an electron accepting coloring developer, and optionally comprises a protective layer which is formed overlying the recording layer, wherein the recording layer becomes a colored state when heated at a temperature higher than or equal to an image forming temperature and then cooled at a cooling speed (1), and the colored state of the recording layer becomes a non-colored state when heated at a temperature below the image forming temperature and higher than or equal to an image erasing temperature or when heated at a temperature higher than or equal to the image forming temperature and then cooled relatively slowly compared to the cooling speed (1);

heating the recording layer with a heating device at a temperature below the image forming temperature and higher than or equal to the image erasing temperature or heating the recording layer with a heating device at a temperature higher than or equal to the image forming temperature and then cooling relatively slowly compared to the cooling speed (1) to make the recording layer be non-colored state; and then imagewise heating the recording layer with a heating device at a temperature higher than or equal to the image forming temperature and then cooling the recording layer at the cooling speed (1) to form an image.

* * * * *